US006454320B1

(12) United States Patent
Weinerman et al.

(10) Patent No.: US 6,454,320 B1
(45) Date of Patent: Sep. 24, 2002

(54) PUSH BUTTON OPERATORS FOR LATCHES AND LOCKS AND LOCKING SYSTEMS EMPLOYING LOCKABLE PUSH BUTTON OPERATORS

(75) Inventors: Lee S. Weinerman, Medina; Arthur J. Kuminski, Parma, both of OH (US)

(73) Assignee: The Eastern Company, Cleveland, OH (US)

( * ) Notice: Subject to any disclaimer, the term of this patent is extended or adjusted under 35 U.S.C. 154(b) by 104 days.

(21) Appl. No.: 09/698,416

(22) Filed: Oct. 27, 2000

Related U.S. Application Data

(63) Continuation-in-part of application No. 29/113,063, filed on Oct. 28, 1999, now Pat. No. Des. 445,015.

(60) Provisional application No. 60/162,309, filed on Oct. 28, 1999.

(51) Int. Cl.[7] ..... E05C 9/12

(52) U.S. Cl. ..... 292/56; 290/53; 290/DIG. 37; 70/208

(58) Field of Search ..... 170/208, 360; 292/56, 53, 26, 30, 48, 47, DIG. 37

(56) References Cited

U.S. PATENT DOCUMENTS

| | | | |
|---|---|---|---|
| 417,589 | A | 12/1889 | Rose |
| 491,824 | A | 2/1893 | Walker |
| 767,567 | A | 8/1904 | Keil |
| 876,300 | A | 1/1908 | Couret |
| 925,455 | A | 6/1909 | Campbell |
| 1,058,346 | A | 4/1913 | Berstler |
| 1,531,605 | A | 3/1925 | Gaynor |
| 1,556,864 | A | 10/1925 | Mendenhall |
| 1,571,453 | A | 2/1926 | Maxon |
| 1,672,901 | A | 6/1928 | North |
| 1,965,939 | A | 7/1934 | Jacobi ..... 70/29 |
| 2,059,479 | A | 11/1936 | North ..... 292/127 |

(List continued on next page.)

OTHER PUBLICATIONS

Eberhard Manufacturinc Co, Cleaveland, OH "Industrial, Vehicular & Specialty Hardware—Catalog 107," 1996, Cover & pp. 63–69.

Tri/Mark, New Hampton, IA "40–400 Push Button Center Control" 2–Page Brochure, Dated Jan. 1998.

Tri/Mark, New Hampton, IA "Twelve Figures From Pending Application" Understood to Have Been Filed in 1998.

Southco, Inc. "Handbook 39" Catalog P. H–3, 1989, Concordville, PA 19331 (Shows Finger Pull).

Southco, Inc., Catalog Page Entitled "Corrosion Resistant Push Lock," Date Belived to be 1990, (Shows Finger Pull With Push But. Latch).

*Primary Examiner*—Teri Pham Luu
(74) *Attorney, Agent, or Firm*—David A. Burge

(57) ABSTRACT

Weather resistant push button operator assemblies usable with a variety of latch and lock systems are disclosed that employ O-ring seals along inner and outer diameters of tubular push button operators that may be provided with key operated lock cylinders. A clamp-on bracket and linkage assembly is disclosed that may be used to enable the push button operator assemblies to pivot pairs of latch connected links in opposite directions to concurrently release pairs of remotely located latches. Also disclosed is a latch and lock system for holding closed a hinged lid of an elongate tool box of the type often mounted on pickup trucks, including lockable first and second push button operator assemblies located near opposite end regions of the tool box, and first and second rotary latch assemblies located substantially equidistantly from an imaginary center plane situated midway between the push button operator assemblies where a reversing crank is provided that connects with links arranged substantially symmetrically about the center plane to enable either of the push button operators to concurrently release the latch assemblies. Symmetrically arranged sets of left and right components of the latch and lock system give each of the push button operator assemblies-the same "feel" when used to concurrently release the latch assemblies.

50 Claims, 12 Drawing Sheets

U.S. PATENT DOCUMENTS

| | | | | |
|---|---|---|---|---|
| 2,705,884 | A | 4/1955 | Craig | 70/264 |
| 2,728,214 | A | 12/1955 | Graig | 70/149 |
| 2,755,519 | A | 7/1956 | Xander | 20/52 |
| 2,772,908 | A | 12/1956 | Craig | 292/280 |
| 2,911,247 | A | 11/1959 | Corbin | 292/48 |
| 2,987,907 | A | 6/1961 | Cockburn et al. | 70/135 |
| 3,054,634 | A | 9/1962 | Westerdale | 292/336.3 |
| 3,602,017 | A | 8/1971 | Bauer | 70/78 |
| 3,964,280 | A | 6/1976 | Kelton | 70/84 |
| 4,084,417 | A | 4/1978 | Daniel | 70/431 |
| 4,488,669 | A | 12/1984 | Waters | 224/273 |
| 4,978,152 | A | 12/1990 | Bisbing | 292/169 |
| D324,635 | S | 3/1992 | Weinerman et al. | D8/331 |
| 5,308,126 | A | 5/1994 | Weger, Jr. et al. | 292/53 |
| 5,346,266 | A | 9/1994 | Bisbing | 292/64 |
| 5,439,260 | A | 8/1995 | Weinerman et al. | 292/48 |
| 5,564,295 | A | 10/1996 | Weinerman et al. | 70/208 |
| 5,586,458 | A | 12/1996 | Weinerman et al. | 70/208 |
| 5,611,224 | A | 3/1997 | Weinerman et al. | 70/208 |
| 5,816,630 | A | 10/1998 | Bennett et al. | 292/341.17 |
| 5,884,948 | A | 3/1999 | Weinerman et al. | 292/216 |
| D429,141 | S | 8/2000 | Antonucci et al. | D8/331 |
| 6,113,160 | A | 9/2000 | Johansson et al. | 292/169 |
| D432,389 | S | 10/2000 | Johansson et al. | D8/331 |
| 6,349,577 | B1 | 2/2002 | Hansen et al. | 70/159 |

PUSH BUTTON OPERATORS FOR LATCHES AND LOCKS AND LOCKING SYSTEMS EMPLOYING LOCKABLE PUSH BUTTON OPERATORS

REFERENCE TO PROVISIONAL APPLICATION

This application claims the benefit of U.S. Provisional Application Serial No. 60/162,309 filed Oct. 28, 1999 by Lee S. Weinerman et al entitled LATCH AND LOCK SYSTEM FOR TRUCK TOOL BOXES HAVING LOCKABLE PUSH BUTTON OPERATORS, the disclosure of which is incorporated herein by reference.

CROSS-REFERENCE TO RELATED APPLICATION

The present application also is a continuation-in-part of design application Ser. No. 29/113,063 filed Oct. 28, 1999 by Lee S. Weinerman et al, issued as U.S. Pat. No. D44,5015, entitled FRONT EXTERIOR PORTION OF A LATCH OR LOCK HOUSING WITH PUSH BUTTON OPERATOR, relating to appearance features of push button operators that may be utilized in the practice of the present invention, the disclosure of which is incorporated herein by reference.

REFERENCE TO SUBJECT-MATTER RELATED APPLICATION

Reference also is made to a concurrently filed design application, Ser. No. 29/131,819 filed by Lee S. Weinerman et al, issued as U.S. Pat. No. D447,002 entitled CLAMP BRACKET ASSEMBLY WITH J-SHAPED LINKAGE ARMS FOR USE WITH PUSH BUTTON LATCH AND LOCK OPERATING ASSEMBLIES, relating to appearance features of a clamp-on bracket and linkage assembly that can be attached to push button operator assemblies, the disclosure of which is incorporated herein by reference.

BACKGROUND OF THE INVENTION

1. Field of the Invention

The present invention relates to improvements 1) in weather resistant push button operators or "operating assemblies" for latches and locks that are capable of providing good service longevity in exterior environments, for example when used to secure tool boxes mounted on pickup trucks, or the like; 2) in bracket and linkage assemblies for connection to the housings of push button operators for adapting the push button operators to substantially concurrently operate a pair of remotely located latches or "latch assemblies;" and, 3) in push button controlled latch and lock systems for holding closed the hinged lids of tool boxes of the type often mounted on pickup trucks, or the like, where lockable push button operator assemblies are provided at opposite end regions of the body or lid of the tool box, with each of the push button operator assemblies being capable of concurrently releasing a pair of latch assemblies connected to the tool box body at substantially equally spaced locations on opposite sides of a center plane of the box, and wherein the systems utilize novel and improved symmetrical arrangements of the push button operators, the latch assemblies they operate, and the linkage components that interconnect the push button operators with the latches to offer smooth operation with substantially equal application of force, and to provide substantially the same operational "feel" regardless of which of the two push button operator assemblies is used to substantially concurrently release the grip of the latch assemblies on suitably positioned strikers.

2. Prior Art

Push button operated latches and locks are well known. Over the years, many have been designed for relatively light duty interior applications where weather resistance is not of concern, for example to secure glove compartment doors in vehicles. More recently, some proposals have addressed the need for heavier duty push button operators to be used exteriorly, for example to secure the elongate doors of tool boxes of the type carried by pickup trucks, or the like. A drawback of previously proposed push button operator assemblies has been the ease with which moisture may seep past the push buttons and/or past the lockable key cylinders carried by the push buttons of these assemblies. If moisture can move with ease alongside the push buttons and/or alongside the key cylinders carried by the push buttons, this moisture may enter the tool box and may cause corrosion and damage to components of the locking system, to the tool box itself, and to the contents of the tool box. Thus, a need has remained for improved lockable push button operator assemblies that not only employ reliable sets of simply configured, easy to assemble components but also offer improved weather resistance.

Rotary latch assemblies are well known that employ a stamped, elongate housing which is provided near one end with a notch for receiving a latch striker, which is provided near the opposite end with a pivotal release lever, and which provides a notched rotary jaw carried by the housing together with other latch elements to enable the rotary jaw to retain the striker in the notch of the housing until released by pivoting the release lever from a retaining position to a release position. Among the patents that disclose a preferred type of rotary latch assembly that takes a simple and relatively inexpensive form that has a proven track record of reliability and service longevity (referred to hereinafter as the "Patented Rotary Latch Assembly") are the following patents issued to Lee S. Weinerman et al: U.S. Pat. No. 5,439,260 issued Aug. 8, 1995; U.S. Pat. No. 5,564,295 issued Oct. 15, 1996; U.S. Pat. No. 5,586,458 issued Dec. 24, 1996; U.S. Pat. No. 5,595,076 issued Jan. 21, 1997; U.S. Pat. No. 5,611,224 issued Mar. 18, 1997; and, U.S. Pat. No. 5,884,948 issued Mar. 23, 1999. The disclosures of these patents are incorporated herein by reference.

Attention is particularly directed to U.S. Pat. No. 5,884,948 wherein features of the most recently improved form of the Patented Rotary Latch Assembly are disclosed, and to FIGS. 22–25 of this patent wherein examples are provided of some of the ways in which pivotal release levers may be connected to the housings of these latches. The rotary latches that are depicted in the drawings of the present application preferably take the improved form that is disclosed in U.S. Pat. No. 5,884,948, have housing carried latch components that preferably are identical to those described in U.S. Pat. No. 5,884,948, and preferably employ pivotal release levers that operate in substantially the same manner as the four differently configured release levers that are utilized by the four rotary latch embodiments depicted in FIGS. 22–25 of U.S. Pat. No. 5,884,948.

While it is known to provide elongate tool boxes of the type often mounted on pickup trucks with 1) a pair of rotary latches assemblies that are supported by the body of the tool box for receiving latch strikers that are carried by the hinged lid of the tool box, 2) a pair of lockable push button operator assemblies mounted on opposite ends of the tool box body, and 3) a linkage that interconnects the push button operator assemblies and the rotary latch assemblies to enable either of the push button operator assemblies to concurrently release the rotary latch assemblies, a number of drawbacks have been encountered with previously proposed systems of this type.

Among the drawbacks exhibited by prior proposals is the noticeably unequal magnitude of force that typically is required to operate the left and right push buttons to release the rotary latch assemblies—a distinct difference that exists because the linkage that interconnects the push button operator assemblies and the rotary latch assemblies is not "symmetrical" in character and tends to bind when more force is applied to one of its ends by one of the push buttons than when force is applied to the other of its ends by the other of the push buttons. Because the interconnection linkage is "non-symmetric," what each of the push button operator assemblies connects with is a different arrangement of linkage components—in essence, a linkage that offers a different arrangement of components to each of the left and right push button operator assemblies. Typically, one of the push buttons has a reversing crank located quite near to it, while the other push button therefore faces a linkage that has the reversing crank near the opposite end of its chain of components.

As those who are skilled in the art will readily appreciate, it is not unusual to find that very different magnitudes of force are required to move a chain of components through identical movements depending on which of the components that one selects to receive the force application that causes movement. Such is the case with prior proposals that utilize "non-symmetric" linkages that differ significantly in character depending on which of the push button operators is called upon to operate these linkages. The resulting difference in required operating force and the tendency of prior interconnection linkages to bind more when operated by one of the push buttons than when operated by the other of the push buttons is not well received by purchasers and can generate undue wear and diminished service life.

With respect to another push-button-operator related subject, bracket and linkage assemblies have been proposed for attachment to the rear end regions of the housings of push button operator assemblies for the purpose of converting the forward-rearward movement of the push buttons to oppositely directed left and right movements for concurrently operating a pair of remotely located latches. The manner in which these bracket and linkage assemblies attach to the rear end regions of the housings of the push button operating assemblies often has left something to be desired. For example, inasmuch as these bracket and linkage assemblies sometimes need to be attached within the confines of the interiors of door assemblies after the push button operating assemblies have been installed by inserting the rear end regions of their housings through mounting holes defined by the exterior skins of the doors, the connections need to be easy-to-complete within a minimum of surrounding space.

Moreover, because the housings of the push button operators often are positioned in close proximity to structural elements of the doors on which they are mounted (or in close proximity to a complex of moving parts or closely adjacent the elements of other systems that are found inside the door structures and/or at locations behind the exterior skins of the doors on which they are mounted), it is desirable that the bracket and linkage assemblies be attachable to the rear-most part of the end regions of the housings of the push button operators in a manner that provides strong, rigid and correctly orienting connections without utilizing bracket elements or other mounting components such clips or other fastening devices that extend forwardly alongside the housings of the push button operators. These needs have not been adequately addressed by the bracket and linkage assemblies of prior proposals. Accordingly, a need has remained for improved bracket and linkage assemblies that can be connected rigidly, securely, and with real ease to the rear-most end regions of the housings of push button operator assemblies without employing bracket elements or mounting components that extend forwardly from the rear-most end regions of the housings on which the bracket and linkage assemblies are mounted.

SUMMARY OF THE INVENTION

The present invention addresses the foregoing and other drawbacks of the prior art by providing push button operator assemblies featuring improved weather resistance; improved bracket and linkage assemblies for attachment to the housings of the push button operator assemblies for operating left and right remotely located latches; and improved, fully symmetrical linkages for interconnecting left and right push button operator assemblies with the release levers of left and right rotary latch assemblies that preferably are of the Patented Rotary Latch Assembly type.

One feature resides in the provision of a latch and lock system having an interconnection linkage that is "symmetric" because it offers a substantially identical arrangement of linkage components to each of the push button operator assemblies. Each of the push button operator assemblies applies latch releasing force to a one rod-like link that connects with the pivotal release arm of the nearest rotary latch assembly, thence to still another rod-like link that connects with a centrally located reversing crank, thence to a third rod-like link that connects with the pivotal release arm of the other rotary latch assemblies. Neither of the push button operator assemblies sees linkage components that differ substantially in length or in character or in arrangement, hence each requires a substantially identical application of force to effect the release of the rotary latch assemblies from engagement with latch strikers that are carried by the hinged lid of the tool box, and each provides substantially the same operational "feel."

One feature resides in the provision of "symmetric" latch and lock systems that employ symmetrically arranged and configured push button operator assemblies at opposite end regions of the tool box that operate symmetrically arranged and configured rotary latch assemblies that are located at substantially equal distances from an imaginary center plane of the tool box utilizing an interconnection linkage that also is "symmetric" about the imaginary center plane by virtue of its utilizing a reversing crank that is pivoted as close as possible to the location of the imaginary center plane, and that has linkage components extending to the left of the center plane that preferably match the linkage components that extend to the right of the center plane, so that each of the symmetrical push button operator assemblies is called upon to operate a symmetrical arrangement of linkage components connected to symmetrical latch releases. Inasmuch as each of the push button operator assemblies operates a substantially identical arrangements of components, the magnitudes of force that must be applied to either of the push buttons to release the retaining engagement of the latches with the associated strikers are substantially identical, as is the operational "feel" experienced by an operator when using either of the push buttons to concurrently unlatch the latch assemblies.

A further feature of the preferred practice of the present invention resides in the provision of push button operator assemblies that employ tubular push buttons having O-ring seals that operate along the inner and outer diameters of the tubular push buttons to resist the seepage of moisture through the push button operator assemblies. Also, as will become apparent from the detailed description that follows, the push button operators are of improved design and offer compact, easy to assemble sets of components of simple form that are well suited to providing long and reliable service.

Still another feature resides in the provision of improved clamp-on bracket and linkage assemblies that can be attached to the rear end regions of the housings of the push button operator assemblies for converting the forward-rearward movements of push buttons to oppositely directed left and right movements for concurrently operating a pair of remotely located left and right latch assemblies. The housings of the push button operator assemblies are provided with grooves that extend circumferentially about the rear end regions of the housings. Opposite sides of these grooves are engaged by concave formations of a pair of clamp-together components of the bracket and linkage assemblies to securely mount the bracket and linkage assemblies on the rear end regions of the housings. Cooperating formations preferably are provided on the housings at the bottoms of the grooves, and on the clamp-together components at the base of their concave formations to ensure that the bracket and linkage assemblies are properly oriented on the housings of the push button operator assemblies when the clamp-together components are secured by threaded fasteners that preferably are located rearwardly with respect to the housings. J-shaped linkage arms of the bracket and linkage assemblies convert rearward push button movements into equal and opposite pivotal movements of the J-shaped arms to unlatch a remote pair of latch assemblies.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
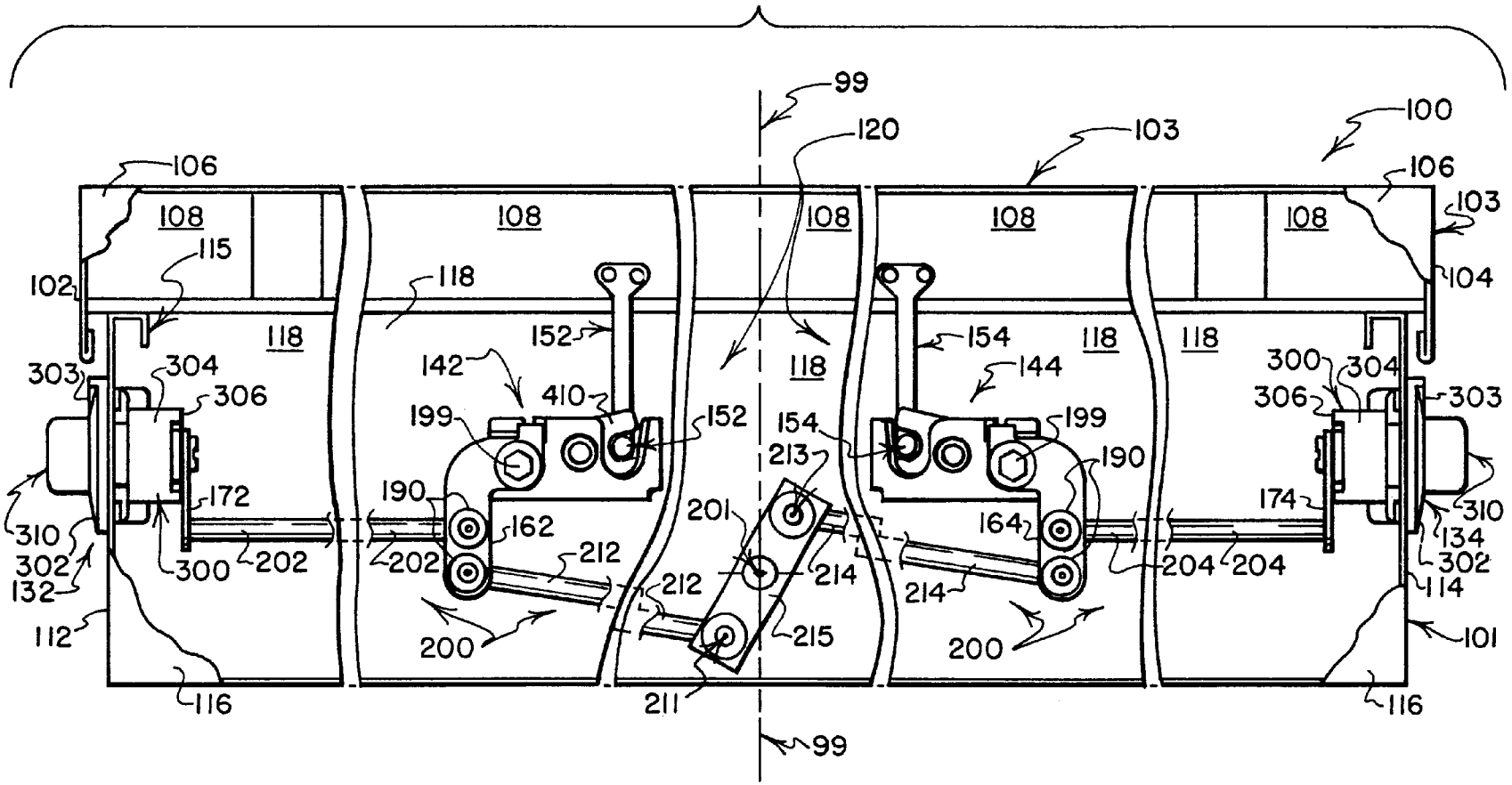
FIG. 1 is a foreshortened side elevational view showing one form of a latch and lock system installed on a tool box of the type often mounted on pickup trucks, with the lid of the tool box closed, with latch strikers carried by the lid received and retained by the rotary latch assemblies of the system, with the push button operator assemblies unlocked and not operated, with the rotary latch assemblies in latched engagement with lid carried strikers, and with front side walls of the tool box body and lid broken away to permit portions of the latch and lock system that are interior to the tool box to be viewed.
Figure 2:
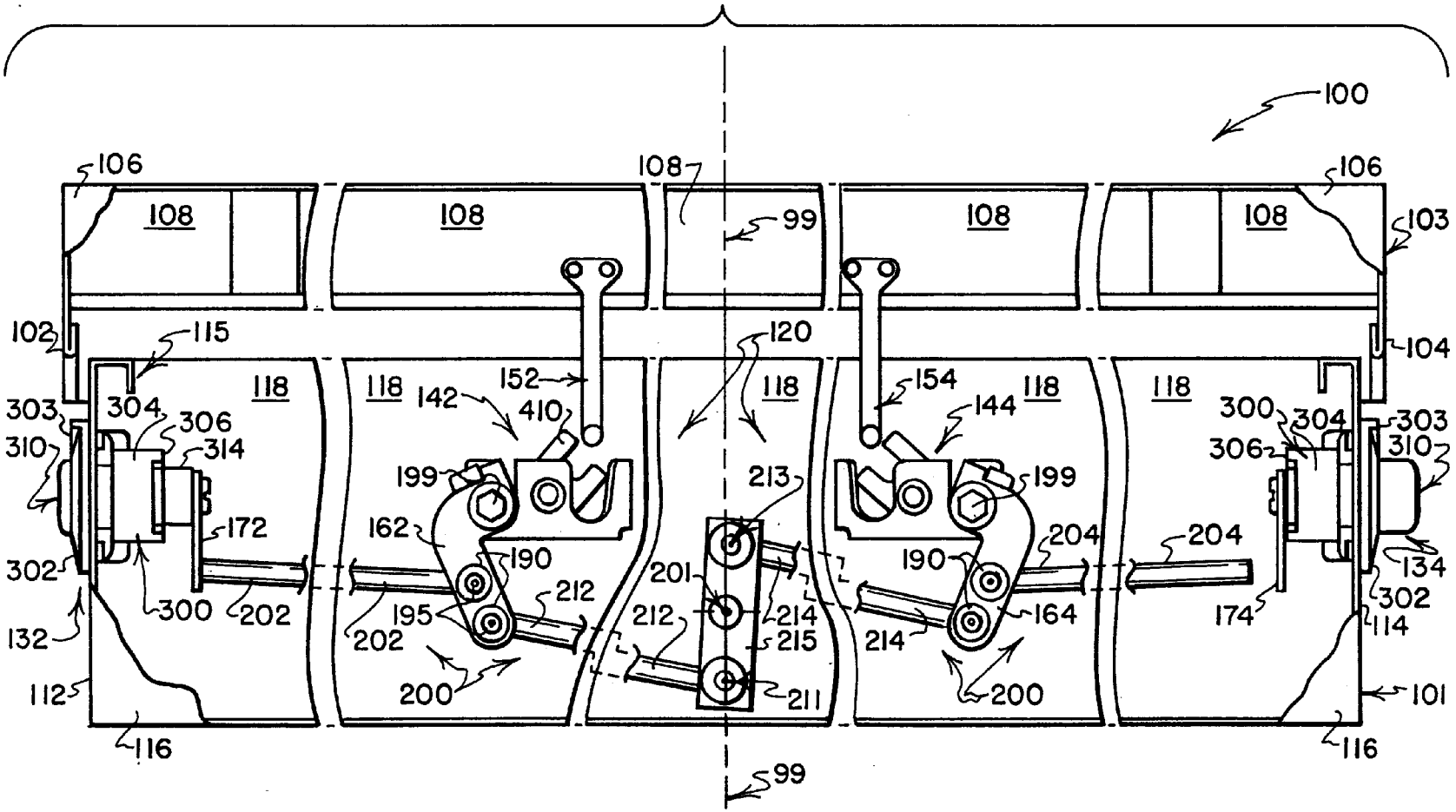
FIG. 2 is a foreshortened side elevational view showing the same tool box and the same latch and lock system as is depicted in FIG. 1, but with the lid of the tool box slightly opened, and with the left push button operator assembly operated to concurrently release the rotary latch assemblies from engagement with the lid-carried strikers.

Referring to FIGS. 1 and 2, a relatively long tool box formed from metal, and being of a type commonly mounted on or carried by pickup trucks and the like, is indicated generally by the numeral 100. The "pickup truck box" or tool box 100 has an elongate body 101 and a hinged lid 103. The closed position of the lid 103 is shown in FIG. 1. FIG. 2 shows the lid 103 pivoted to a partially open position.

The body 101 has opposed end walls 112, 114 that are relatively short in comparison with the length of opposed, front and rear side walls 116, 118 that extend between and cooperate with the end walls 112, 114 to define an upwardly-facing opening 115 that can be closed by the lid 103. The lid 103 has opposed ends or end walls 102, 104 that overlie the end walls 112, 114 of the body 101 when the lid 103 is closed, and opposed sides or side walls 106, 108 that overlie the side walls 116, 118 of the body 101 when the lid 103 is closed. The lid 103 is connected by a hinge (not shown) to the body 101 along the back side of the opening 115 (i.e., along the back side wall 108 of the lid 103).

While the lid 103 is depicted as extending along the full length of the body 101 of the box 100, this is not a requirement; nor is it essential that the lid 103 close an upwardly facing opening. Some pickup truck boxes have top or side openings that stop short of the ends of the bodies of these boxes, and the latch and lock systems of the present invention can be used equally well to retain the lids of such boxes closed.

Referring still to FIGS. 1 and 2, a latch and lock system 120 is provided for retaining the lid 103 in closed position relative to the body 101 of the box 100. In preferred practice, major components of the latch and lock system 120 are configured and arranged so as to provide "symmetry" about an imaginary center plane 99—symmetry that helps to ensure that, regardless of which of two push button "operators" or "operator assemblies" 132, 134 (located near opposite ends of the box 100 at substantially equally spaced distances on opposite sides of the center plane 99) are utilized to concurrently release a pair of rotary latch assemblies 142, 144 (supported inside the box 100 at substantially equally spaced distances from the center plane 99), the same unlatching force will be required from, and the same operating "feel" will be provided to, the person who operates the push button operators 132, 134 to substantially concurrently unlatch the latch assemblies 142, 144.

Referring still to FIGS. 1 and 2, in addition to the push button "operators" or "operator assemblies" 132, 134, and in addition to the latch assemblies 142, 144, the latch and lock system 120 includes latch strikers 152, 154 that are carried by the hinged lid 103 and that are engaged and retained by the rotary latch assemblies 142, 144 when the lid 103 is in its closed position, and, an interconnection linkage 200 that serves to drivingly connect the push button operator assemblies 132, 134 with pivotal "releases" or "release levers" 162, 164 of the rotary latch assemblies 142, 144 to concurrently release or "unlatch" the latch assemblies 142, 144 from latchingly or retainingly engaging the strikers 152, 154 in response to operation of either of the unlocked push button operator assemblies 132, 134.

The position of the center plane 99 is not determined by the locations of opposite ends of the opening 115, nor by the location of the opposite ends of the body 101 or the lid 103, but rather by the locations of the push button operators 132, 134 (the center plane 99 is substantially mid-way between them) and by the locations of the latch assemblies 142, 144 (the center plane 99 is substantially mid-way between them). Therefore, it will be understood that while the center plane 99 is depicted as being located substantially mid-way between the ends 112, 114 of the body 101 and as also as being located substantially mid-way between the ends 102, 104 of the lid 103, what is of significant is that the center plane 99 is located substantially mid-way between the push button operators 132, 134 and substantially mid-way between the latch assemblies 142, 144—an arrangement that aids in giving the components of the locking system 120 what can be referred to as "positional symmetry" about the center plane 99.

Depending on how an opening that is closed by a the lid of a pickup truck box is located relative to the opposed ends of the particular box, it is possible that the so-called center plane 99 may be located substantially mid-way between the opposed ends 102, 104 of the lid 103 but not necessarily substantially mid-way between the opposed ends 112, 114 of the body 101, or vice versa. If, for example, the push button operators 132, 134 are mounted on the opposed ends 112, 114 of the body 101 of the box 100 (which corresponds with the arrangement that is depicted in FIGS. 1 and 2), the center plane 99 will be located substantially mid-way between the ends 112, 114 of the body 101 of the box 100. However, if the push button operators 132, 134 are mounted on the opposed ends 102, 104 of the lid 103 of the box 100 (which means that the latch assemblies 142, 144 also would be mounted on the lid 103, but with the strikers 152, 154 being connected to the body 101—an arrangement that will be readily understood by those who are skilled in the art and therefore does not need to be shown in the drawings), then the center plane 99 will be located substantially mid-way between the ends 102, 104 of the lid 103 of the box 100.

The interconnection linkage 200 includes a reversing crank or crank arm 215 that is housed inside the box 100 and mounted for pivotal movement about an axis 201 between a non-operated position shown in FIG. 1, and an operated position shown in FIG. 2. The axis 201 is located as near as possible to the center plane 99, and preferably resides within the center plane 99—although some pickup truck box designs will not accommodate the positioning of the axis exactly at or within the center plane 99 because structural features of the boxes located mid-way along the length of the boxes may interfere with such center plane mounting of the reversing crank 215.

Symmetry of the linkage 200 is aided (so that operation of the push button operator assemblies 132, 134 will require the same force and provide the same operational "feel" regardless of which of the push button operators 132, 134 is employed to unlatch the latch assemblies 142, 144) by mounting the crank arm 215 so that its pivot axis 201 resides at, within or at least quite close to the center plane 99. The crank arm 215 has opposed end regions that extend in opposite directions away from the pivot axis 201 to define a left or first connection point 211, and a right or second connection point 213. The connection points 211, 213 are located equidistantly from the pivot axis 201.

The interconnection linkage 200 also includes left and right, or first and second linkage halves—with the right half including a first left link that extends between the left or first push button operator 132 and the left or first release arm 162 of the left or first latch assembly 142, and a second left-central link that extends between the release arm 162 and the first or left point of connection 211 of the crank arm 215; and, with the left half including a third right link that extends between the right or second push button operator 134 and the right or second release arm 164 of the right or second latch assembly 142, and a fourth right-central link that extends between the release arm 164 and the second or right point of connection 213 of the crank arm 215. As will be apparent, these various components of the latch and lock system 200 feature not only "positional symmetry" about the center plane 99 (i.e., the left components are positioned substantially the same distances from the center plane 99 as the corresponding right components) but also "arrangement symmetry" about the center plane 99 (in that the left and right push button operator assemblies 132, 133 and the left and right latch assemblies 142, 144 and the links that interconnect these components are configured such that the left components are, in large measure, "mirror images" of the right components); and, as also will be noted, "operational symmetry" about the center plane 99 is provided by the fact that component movements that take place on the left side of the center plane 99 are matched by substantially equal but opposite movements of corresponding components situated on the right side of the center plane 99.

In FIG. 1, the strikers 152, 154 are shown latchingly or retainingly engaged by the rotary latch assemblies 142, 144, respectively, to hold the lid 103 closed with respect to the body 101 of the tool box 100. In FIG. 2, the strikers 152, 154 are shown disengaged by the rotary latch assemblies 142, 144, thereby permitting the lid 103 to open, and the left push button operator assembly 132 is shown operating the rotary latch assemblies 142, 144 by pivoting the releases or release levers 162, 164 of the rotary latch assemblies 142, 144 from non-operated positions (shown in FIG. 1) to operated positions. One of the "operated positions" is depicted in FIG. 2 wherein it will be seen that an operating formation or operating arm 172 of the first push button operator 132 has moved toward the center plane 99 to cause concurrent pivoting of the releases or release levers 162, 164 of the latch assemblies 142, 144 to release the strikers 152, 154, respectively.

When the push button operator assemblies 132, 134 are "unlocked," either of the push button operator assemblies 132, 134 can be operated to move its operating arm 172 or 174 between its non-operated and operated positions. When the left locking arm 172 (of the unlocked left push button operator assembly 132) is pushed rightwardly (as is depicted in FIG. 2), or when the right locking arm 174 (of the unlocked right push button operator assembly 134) is pushed leftwardly, the adjacent one the left and right links 202, 204 is moved toward the center plane 99 which causes the nearest one of the release levers 162, 164 to pivot to its operated position which, in turn, causes left-central and right-central links 212, 214 which are interconnected by a centrally pivoted reversing crank 215 to move generally toward each other, thereby causing the other of the release levers 162, 164 to be concurrently pivoted to its operated position.

Inasmuch as 1) the left and right push button operator assemblies 212, 214 are substantially identical, 2) the left and right links 202, 204 are substantially identical, 3) the left and right rotary latch assemblies 142, 144 are substantially identical (they are left and right mirror image reversals of each other), and 4) the left-central and right-central links 212, 214 are substantially identical and are substantially identically connected to opposite ends of the centrally pivoted reversing crank 215, substantially equal force is required to operate either of the push button operator assemblies to concurrently release the latch assemblies 142, 144, and the interconnecting linkage 200 can be said to be "substantially symmetrical" (insofar as the positions, arrangement and operation of its components are concerned) about the imaginary center plane 99.

Operational symmetry also preferably is enhanced by ensuring that the pivot axis 201 of the crank arm or reversing crank 215 is spaced equidistantly from locations where the central links 212, 214 join with the release arms 162, 164, and that the pivot axis 201 resides along an imaginary line that extends from the location where the left second link 212 joins with the release arm 162 to the location where the right fourth link 214 joins with the release arm 164 (so that the second link 212 angles downwardly toward the connection point 211 of the reversing crank 215 at substantially the same angle that the fourth link 214 angles upwardly toward the connection point 213). Also, it is preferred that the left and right links 202, 204 (i.e., the left first link 202 and the right third link 204) extend substantially in alignment one with another (such as is depicted in FIGS. 1 and 2 where these links are aligned and are shown as extending substantially horizontally at equal heights above the floor of the box 100), or at substantially equal angles of inclination relative to the center plane 99. While no supports are shown for outer end regions of the links 202, 204, it will be understood that the outer end regions of the links 202, 204 preferably are provided with suitable conventional support designed to permit these links to slide smoothly leftwardly and rightwardly while maintaining their alignment with each other (or while maintaining substantially equal angles of inclination relative to the center plane 99 if the links 202, 204 are not aligned with each other in the manner shown in FIGS. 1 and 2), so that operational symmetry of the components of the linkage 200 of the latch and lock system 200 is maintained.

To accommodate such differences as may be encountered in mounting the interconnecting linkage 200 on tool boxes that may vary slightly in dimension due to manufacturing tolerances or other reasons, each of the links 202, 204, 212, 214 is provided with at least one adjustable connector that permits the effective length of each of these links to be adjusted. In preferred practice, adjustable connectors 190 (see FIGS. 10 and 11) for the left links 202, 212 are carried by the left release arm 162 of the left rotary latch assembly 142, and identical adjustable connectors 190 for the right links 204, 214 are carried by the right release arm 164 of the right rotary latch assembly 144.

Figure 10:
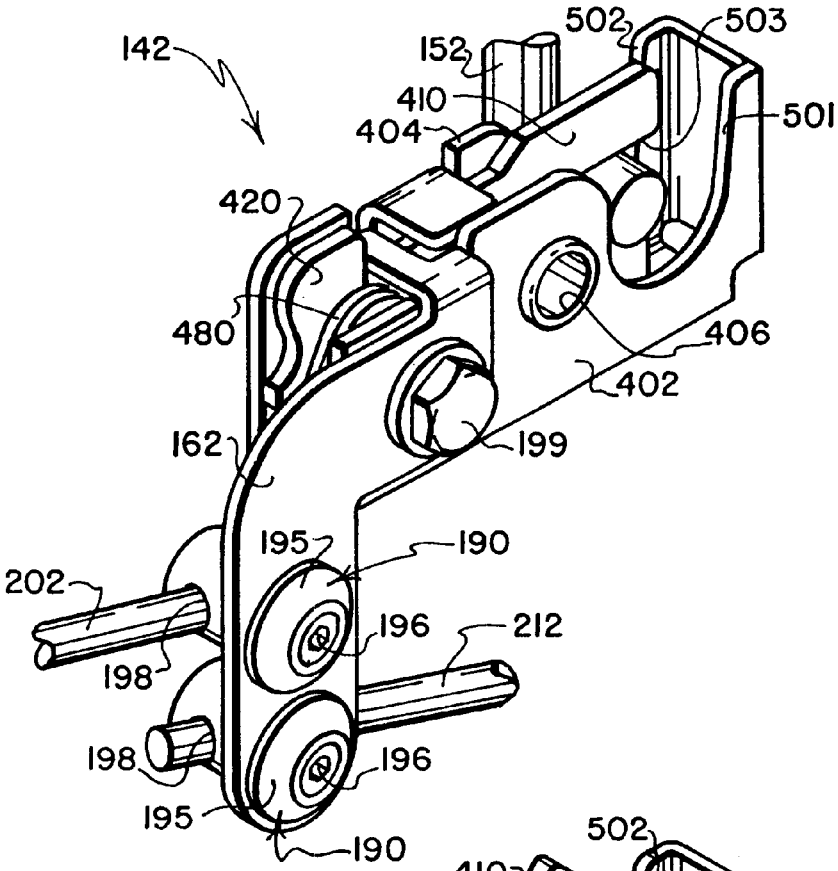
FIG. 10 is a perspective view showing one of the rotary latch assemblies depicted in FIG. 1 in latched engagement with a striker.
Figure 11:
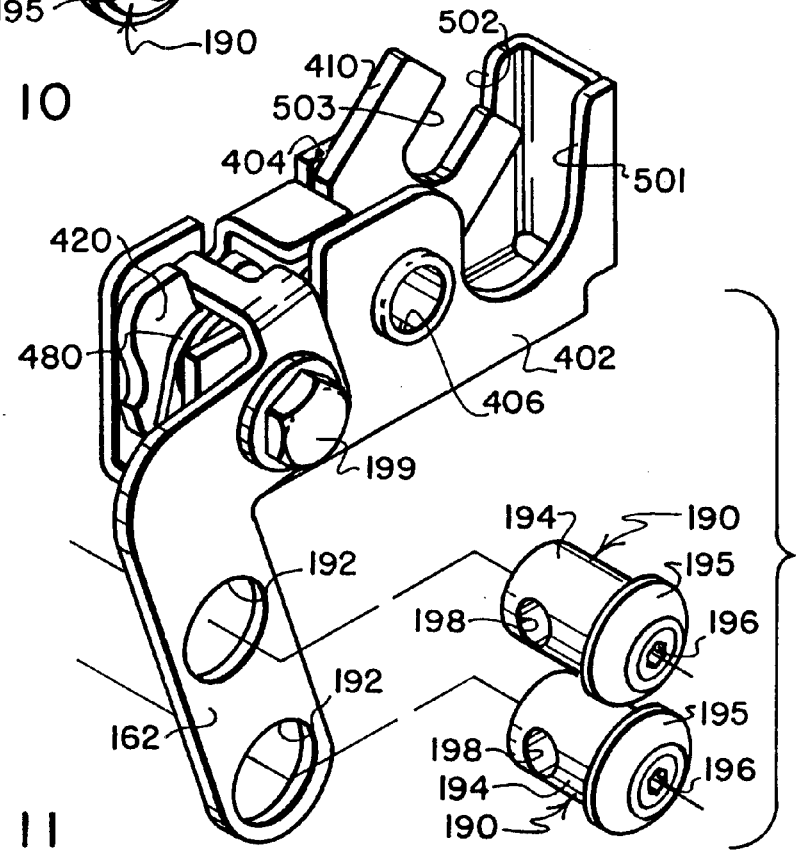
FIG. 11 is a perspective view showing the rotary latch assembly of FIG. 10 operated and unlatched, with adjustable linkage connectors that couple a pair of links to the release arm of the latch assembly removed from the release arm.

Referring to FIGS. 10 and 11, the adjustable connectors 190 that couple the left links 202, 212 to the left release arm 162 are seen to comprise cylindrical plugs 194 that are received in a slip fit within holes 192 (see FIG. 11) formed in the release arm 162. Head formations 195 provided at one end of the plugs 194 have threaded central openings that carry set screws 196 for clampingly engaging the rod-like links 202, 212 that are inserted into transverse holes 198 formed through the plugs 194. When the set screws 196 are loosened, the effective lengths of the links 202, 212 can be adjusted. When the set screws 196 are tightened to clamp the links 202, 212 in the holes 198, rigid connections are formed between the links 202, 212 and the adjustable connectors 190 which pivot, as needed, in the holes 192 that are formed through the release arm 162. Identical adjustable connectors 190 likewise couple the right links 204, 214 in the same manner to the right release arm 164.

Figure 3:
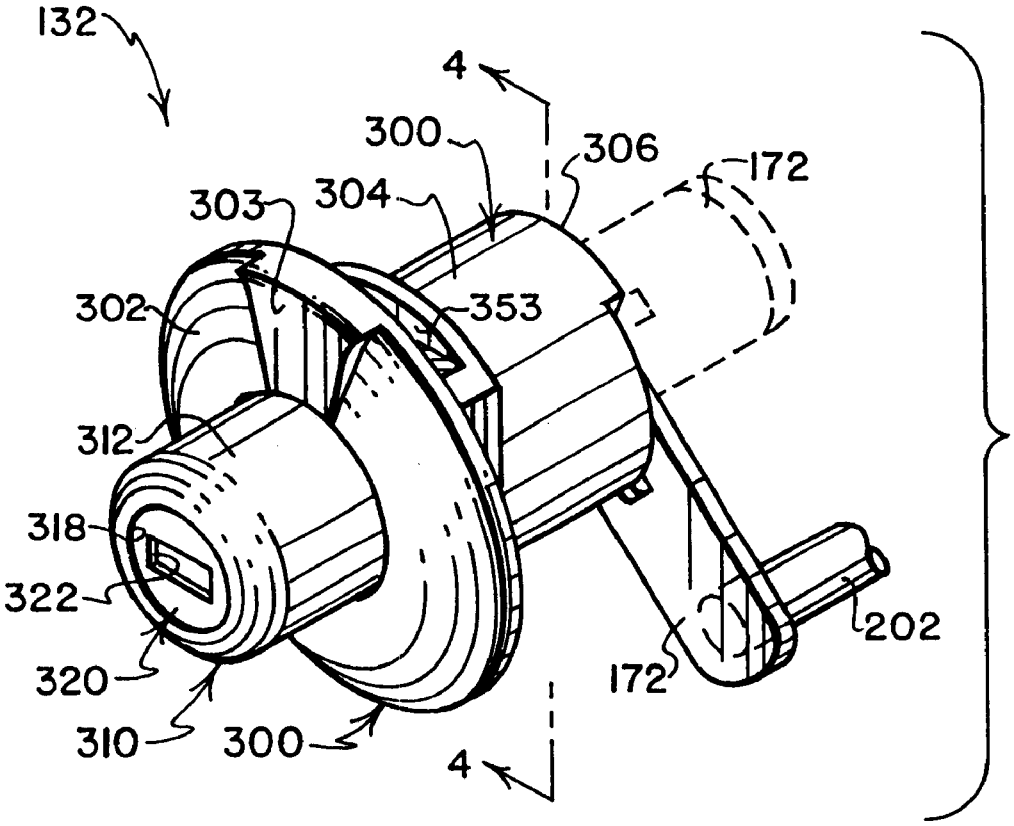
FIG. 3 is a perspective view, on an enlarged scale, of one of the push button operator assemblies employed by the latch and lock system of FIG. 1, with an operating arm of the assembly shown in solid lines in its unlocked non-operated position and in broken lines in its locked non-operated position.
Figure 4:
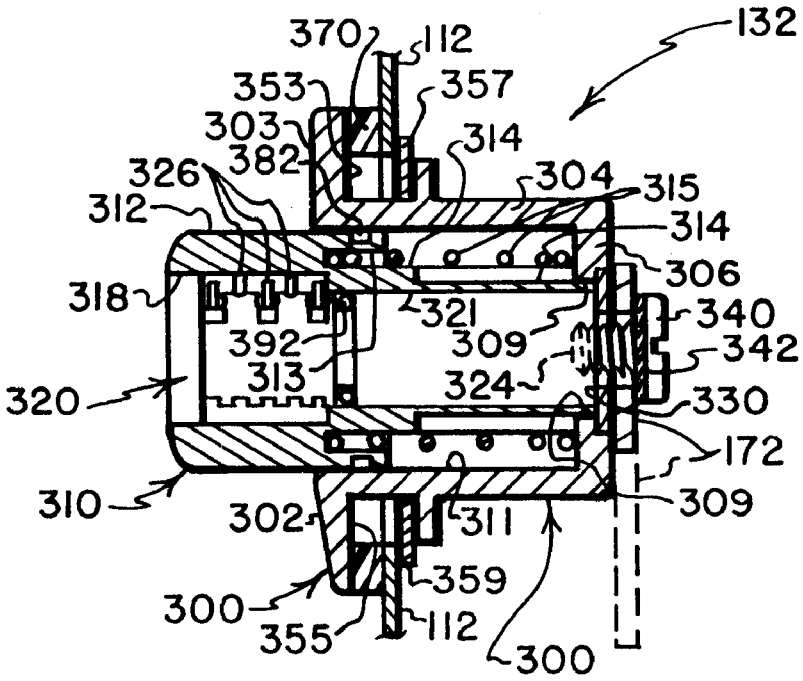
FIG. 4 is a sectional view as seen from a plane indicated by a line 4—4 in FIG. 3, with the push button operator assembly shown mounted on an end wall of the tool box.
Figure 9:
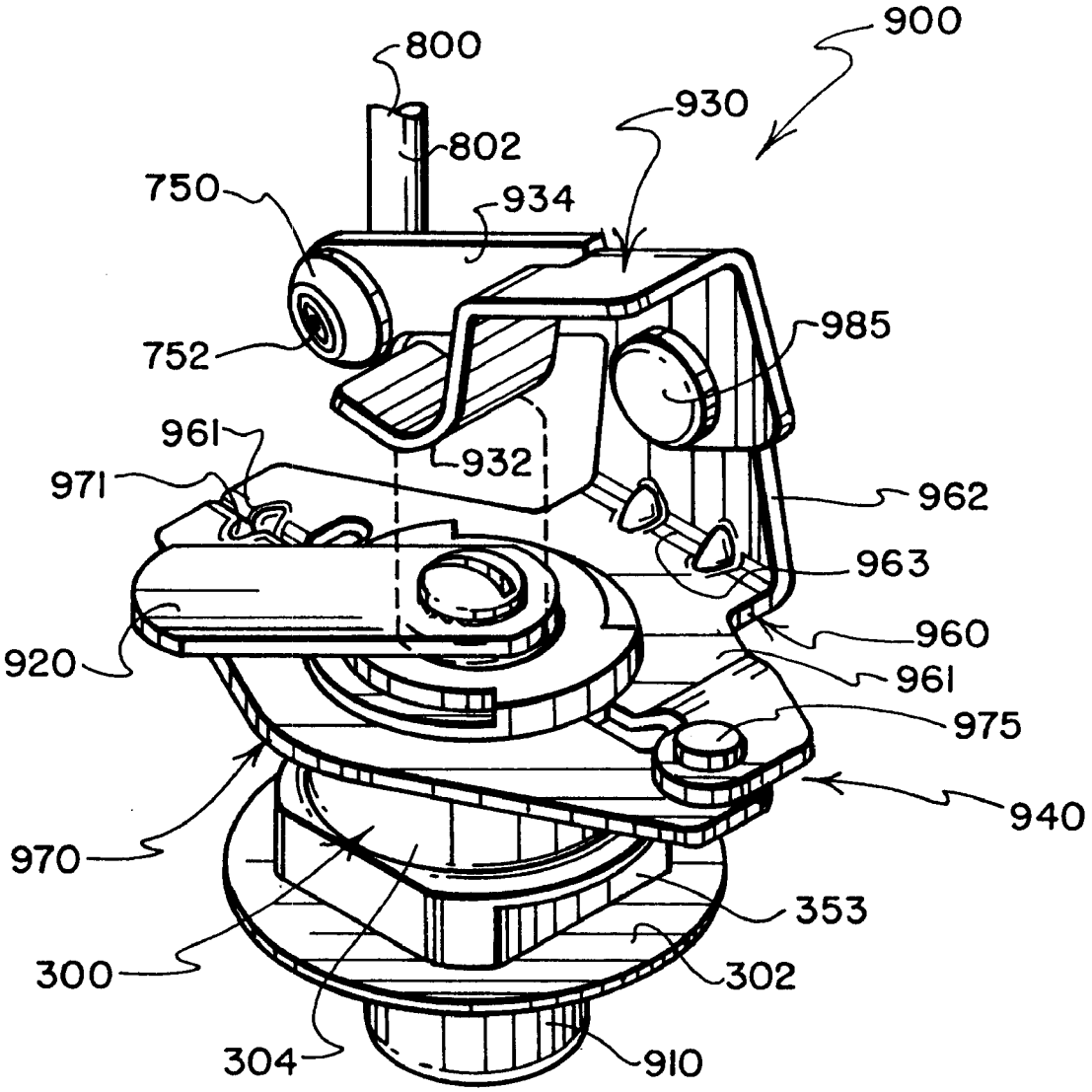
FIG. 9 is an exploded perspective view showing from a different viewpoint features of selected ones of the components that are depicted in FIG. 7.

Referring to FIGS. 3, 4 and 9, the left push button operator assembly 132 includes a generally cylindrical housing 300 that has a front flange 302 and a tubular body 304 that connects with a rear wall 306. A tubular push button 310 has an enlarged diameter front end region 312, rear portions of which are received in a slip fit within an inner diameter 311 of the tubular body 304 of the housing 300. Front portions of the front end region 312 normally project forwardly with respect to the front flange 302 of the housing 300. The tubular push button 310 has a reduced diameter rear end region 314 that extends through a hole 308 (best seen in FIG.

9) formed through the rear wall 306 of the housing 300. When the push button 310 is depressed, as depicted in FIG. 2, the rear end region 314 projects rearwardly (rightwardly as viewed in FIG. 2) beyond the rear wall 306.

Referring to FIG. 4, a compression coil spring 315 is carried within the inner diameter of the tubular body 304 of the housing 300. The spring 315 has a front end region that extends into a counterbore 313 of the push button 310, and a rear end region that engages the rear wall 306 so as to bias the push button 310 forwardly with respect to the housing 300.

A central passage 318 is formed through the push button 310. A generally cylindrical lock core 320 is carried in the passage 318. The core 320 has a key-receiving opening 322 at its front end. A raised, wedge-shaped formation 303 is provided on the front flange 302 to indicate a position toward which the key-receiving opening 322 should point when the push button operator assembly 132 is "locked."

Figures 7, 8:
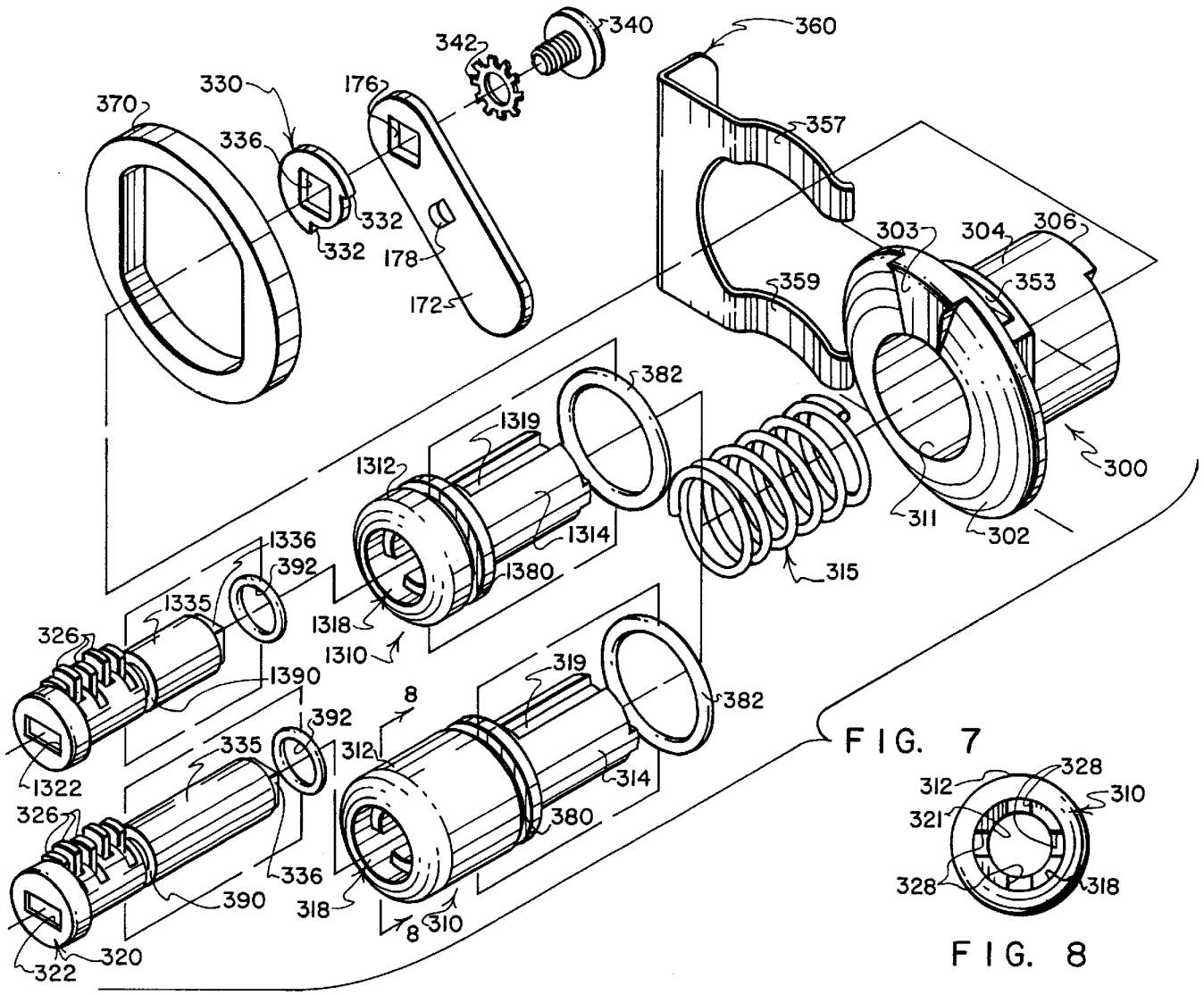
FIG. 7 is an exploded perspective view showing components of the push button operator assemblies of FIGS. 3 and 5.
FIG. 8 is a front side elevational view of one of the push buttons shown in FIG. 7, as seen from a plane indicated by a line 8—8 in FIG. 7.

The core 320 carries spring biased tumblers 326 near its front end that are of conventional form that cooperate in the usual way with a suitably configured key (not shown) when the key is inserted into the key-receiving opening 322 to withdraw the tumblers 326 into the core 320 sufficiently to permit the core 320 to be rotated within the passage 318. As is best seen in FIG. 8, the front end region of the passage 318 is provided with inwardly facing grooves 328, but a rear end region 321 of the passage 318 is of uniform diameter. The grooves 328 are configured to receive the tumblers 326 at 3-, 6-, 9- and 12-o'clock positions to permit the tumblers 326 to extend radially from the core 320 sufficiently to permit the key to be removed from the key-receiving opening 322 when the core 320 is rotated to position the tumblers 326 at any of the 3-, 6-, 9- and 12-o'clock positions. However, as is best seen in FIG. 9, a circumferentially notched washer 330 is provided at the rear of the core 320 that has stop surfaces 332 that cooperate with a stop formation 334 provided at the rear of the push button 310 to limit the rotation of the core 320 (relative to the push button 310) to a ninety degree range of movement. The key is removable from the core 320 when the core 320 is rotated to position the tumblers 326 at either of the ends of this ninety degree range of movement, typically at a 12-o'clock "locked" orientation and at a 3-o'clock "unlocked" orientation.

Also cooperating to limit the rotation of the core 320 (and hence the operating formation or operating arm 172) to a ninety degree range of pivotal movement is a forwardly extending projection 178 (see FIG. 7) provided on the operating formation or operating arm 172 which is received in a notch 378 (see FIG. 9) provided at one side of the back wall 306 of the housing 300. An identical notch 379 (see FIG. 9) is provided at the opposite side of the back wall 306 so the operating formation or operating arm 174 of the right push button lock assembly 134 can be installed properly on the right push button lock assembly 134.

Referring to FIG. 9, the core 320 has a threaded hole 324 at its rear end. The rear end region of the core 320 includes a uniform diameter portion 335 that defines at its rear a square formation 336. The square formation 336 drivingly connects with the notched washer 330 and with the operating formation or operating arm 172 by extending snugly through a square hole 336 formed centrally through the notched washer 330 and into a square hole 176 formed through the operating formation or operating arm 172 near the inner end thereof. Referring to FIG. 7, a threaded screw 340 and a retaining washer 342 are utilized to retain the notched washer 330 and the operating formation or operating arm 172 in place on the square formation 336 at the rear end of the core 320. When the screw 340 is tightened in place, the core 320 is retained within the central passage 318 of the push button 310 and is caused to move axially with the push button 310, for example when the push button 310 is depressed.

When the core 320 is rotated by a suitably configured key to its unlocked position (as shown in solid lines in FIG. 3), the operating formation or operating arm 172 is positioned to engage the left end of the link 202 of the linkage 200. When the core 320 is rotated by a suitably configured key to its locked position (as shown in broken lines in FIG. 3), the operating formation or operating arm 172 is positioned so it is out of alignment with the link 202 and therefore cannot engage and cannot move the link 202 even when the push button 310 is depressed.

Referring to FIG. 9, a pair of opposed, tab-like projections 309 (one of which can be seen in FIG. 9, but both can be seen in FIG. 4) are provided at opposite sides of the rear wall opening 308 of the housing 300. The tab-like projections 309 are configured to extend into grooves 319 that are provided along opposite sides of the rear end region 314 of the push button 310. The extension of the tab-like projections 309 into the grooves 319 prevents the push button 310 from rotating relative to the housing 300, and yet permits the push button 310 to be depressed rearwardly relative to the housing 300 to move the operating formation or operating arm 174 rearwardly (to move the link 202 rightwardly as viewed in FIG. 2 if the operating formation or operating arm 174 is in its "unlocked" position and therefore is aligned with the left end of the link 202). The push button 310 can be depressed regardless of how the core 320 is oriented, and regardless of whether a key is inserted into the key receiving opening 312, but will only be effective to operate the rotary latch assemblies 132, 134 if (when the push button 310 is depressed) the operating formation or operating arm 174 is already in its "unlocked" position (as depicted in solid lines in FIG. 3) so as to be aligned with the left end of the link 202.

Figure 5:
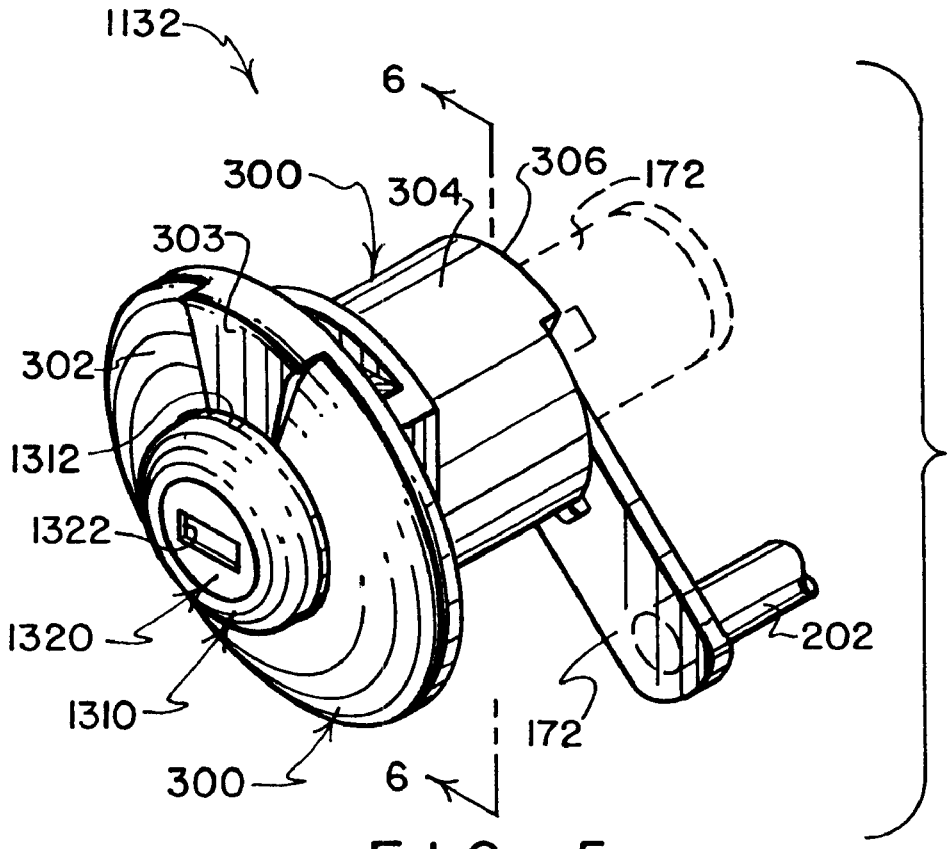
FIG. 5 is a perspective view, on the same scale as FIG. 3, of an alternate form of push button operator assembly, with an operating arm of the assembly shown in solid lines in its unlocked non-operated position and in broken lines in its locked non-operated position.
Figure 6:
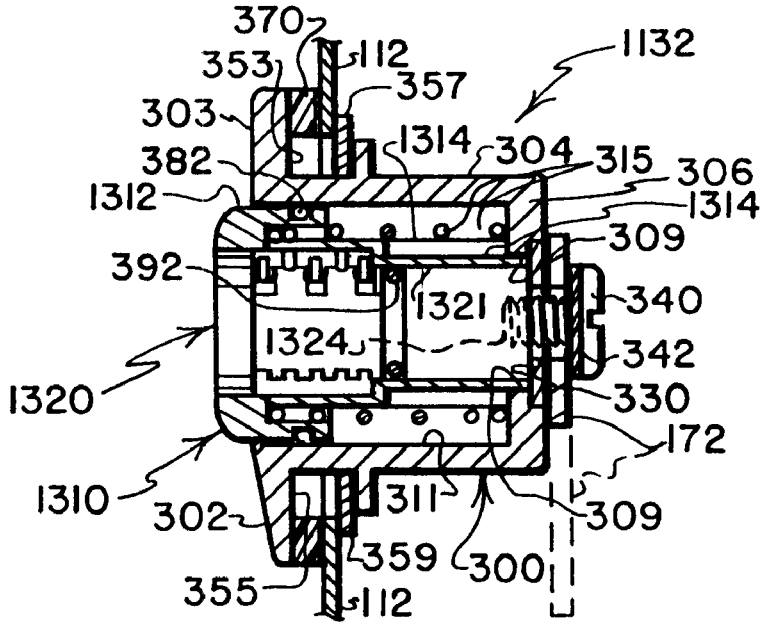
FIG. 6 is a sectional view as seen from a plane indicated by a line 6—6 in FIG. 5, with the push button operator assembly shown mounted on an end wall of the tool box.

Referring to FIGS. 5 and 6, an alternate form of left push button operator assembly 1132 is depicted that is identical to the left push button operator assembly 132 except that it utilizes a push button 1310 and a core 1320 that are shorter than the push button 310 and the core 320 of the push button operator assembly 132. The push button 1310 has a shorter front end region 1312 (i.e., shorter than the front end region 312 of the push button 310) that normally projects only a short distance forwardly from the flange 1302 of the housing 1300, and the core 1320 has a shorter rear end region 1335 (i.e., shorter than the rear end region 335 of the core 320). While the push button 310 of the assembly 132 can be pushed to an operated position (as depicted in FIG. 2) that leaves a short length of the front end region 312 still projecting forwardly from the housing flange 302, the push button 1310 of the assembly 1132 can be pushed to an operated position (not shown) that causes the entire front end region 1312 to move into the inner diameter 311 of the tubular body 304 of the housing 300.

Since the push button operator assemblies 132, 1132 are identical except for the differences in the lengths of their push buttons 310, 1310 and their cores 320, 1320, corresponding numerals that differ by a magnitude of one thousand are utilized in FIGS. 3, 4 and in FIGS. 5, 6 to indicate features of the different length push button operator assemblies 132, 1132 that correspond in general arrangement and function—and, identical numerals are utilized in these FIGURES to indicate other components that are identical in each of the push button operator assemblies 132, 1132. The use of corresponding numerals eliminates the need to repeat portions of the foregoing description that will be understood to be applicable to items that are designated by numerals that "correspond" inasmuch as they differ by a magnitude of one thousand.

Referring to FIGS. 4, 7 and 9, the forward end of the tubular body 304 of the housing 300 has top and bottom notches 353, 355 that are configured to receive opposed legs 357, 359 of a U-shaped retaining clip 360 (see FIG. 7) to hold the housing 300 in position on the left end wall 112 of the tool box body 101, as is depicted in FIGS. 4 and 6. A resilient gasket 370 is compressed between the housing flange 302 and the end wall 112 to stop the passage of unwanted moisture through an appropriately configured hole formed through the end wall 112 that receives the tubular body 304 of the housing 310.

Referring to FIG. 7, other features of the push button operator assembly 132 include the provision of circumferentially extending grooves 380, 390 on the front end region 312 of the push button 310 and on the rear end region 335 of the core 320 that receive O-rings 382, 392, respectively, for preventing the passage of unwanted moisture along the outer and inner diameters of the push button 310. The presence of the O-rings 382, 392 significantly enhances the weather resistance of the push button operator assembly 132 by preventing moisture from traveling along the outer and inner diameters of the tubular core 320.

The rotary latch assemblies 142, 144 are left and right versions (i.e., they are mirror image reversals of each other) that preferably are of the type sold by Eberhard Manufacturing Co. division of The Eastern Company, Cleveland, Ohio 44136 under the product designation 4-242. While features of the components of, and the manner of operation of, this type of rotary latch are described in the Patented Rotary Latch Assembly patents that are identified previously (the disclosures of which are incorporated herein by reference), a brief description is included in the next several paragraphs so that the basic features and operation of the rotary latches 142, 144 will be understood without referring to other documents. Additional details are available in the referenced patents.

Referring to FIGS. 10 and 11, the rotary latch assembly 142 has what will be referred to as a "housing" that consists of opposed first and second housing side plates 402, 404. The side plates 402, 404 are held in spaced, parallel relationship by a pair of spacers or bushings 406 (one of which can be seen in FIGS. 10 and 11, whereas the other is hidden from view by the release lever 162 and by a bolt 199 that extends through the hidden bushing to pivotally connect the release lever 162 to the housing of the rotary latch assembly 142). The preferred manner in which the bushings 406 have their opposite end regions deformed to establish rigid connections with the side plates 402, 404 is described in referenced U.S. Pat. No. 5,884,948.

The side plates 402, 404 define aligned first and second U-shaped notches 501, 502, respectively, that are oriented so that, as the strikers 152, 154 are moved toward the latch assemblies 142, 144 during closure of the tool box lid 103, the striker 152 will be received in the first and second U-shaped notches 501, 502 of the latch assembly 142 (at the same time that the striker 154 is received within corresponding U-shaped notches of the latch assembly 144). As the striker 152 enters the first and second U-shaped notches 501, 502, it also is received in a third U-shaped notch 503 defined by a rotary jaw 410 of the latch assembly 142—and the third U-shaped notch 503 functions in concert with the first and second U-shaped notches 501, 502 as the rotary jaw 410 serves to receive and pivots to latchingly retain the striker 152 in the notches 501, 502, 503 as the lid 103 is moved to its completely closed position. The preferred configuration of the notches 501, 502, and the manner in which the notches 501, 502 preferably are aligned to receive a striker is described in greater detail in U.S. Pat. No. 5,884,948.

Also housed between the side plates 402, 404 (in addition to the rotary jaw 410) is a rotary pawl 420. The rotary jaw 410 has a mounting hole (not shown) that receives one of the bushings 406 to mount the rotary jaw 410 for pivotal movement relative to the side plates 402, 404. Likewise, the rotary pawl 420 has a mounting hole (not shown) that receives the other of the bushings 406 to mount the rotary pawl 420 for pivotal movement relative to the side plates 402, 404.

Also housed between the side plates 402, 404 is a torsion coil spring 480 that has coils that extend about the bushings 406. End regions of the spring 480 engage the rotary jaw 410 and the rotary pawl 420 to bias these elements in a manner (described in the referenced patents) that permits interactive formations of these elements to cooperate to retain the striker 152 in latched engagement with the latch assembly 142 until the release lever 162 is pivoted (about the axis of the mounting bolt 199 that extends through one of the bushings 406), as is shown in FIG. 11, to release the grip of the rotary pawl 420 on the rotary jaw 410 so the rotary jaw 410 can pivot under the influence of the spring 480 to release the striker 152. This type of pawl-controlled jaw latching action is well known to those who are skilled in the art, and is further illustrated and described in a number of the patents that are identified above.

Unlatching movement of the release lever 162 (and concurrent unlatching movement of the release lever 164) is effected by depressing one of the push buttons of the push button lock assemblies 132, 134 at a time when the associated operating formation or operating arm 172, 174 is in its "unlocked" position (i.e., when the associated operating formation or operating arm 172, 174 is aligned with and engageable with the associated link 202, 204).

As the release lever 172 pivots to the position shown in FIGS. 2 and 11, the rotary pawl 420 is pivoted by the release lever 172 to a position where interactive formations of the rotary jaw 410 and the rotary pawl 420 disengage to permit the jaw 410 to rotate to the unlatched position wherein the striker 152 is released. So long as the rotary jaw 410 of the rotary latch assembly 142 is in its unlatched position (depicted in FIG. 11), the striker 152 can always be slammed into latching engagement with the rotary jaw 410—and, the same is true with respect to the identical rotary jaw of the rotary latch assembly 144 and the striker 154.

To fully lock the tool box 100, the lid 103 must be closed to bring the strikers 152, 154 into latched engagement with the rotary latch assemblies 142, 144, and the operating formations or operating arms 172, 174 of both of the push button operator assemblies 132, 134 must be rotated to their locked positions (out of alignment with the links 202, 204). To unlock the tool box 100, either of the push button operator assemblies 132, 134 may be unlocked utilizing an appropriately configured key to move the associated one of the operating formations or operating arms 172, 174 to its unlocked position (in alignment with the associated one of the links 202, 204) so that depression of the associated push button 310 will cause the associated operating formation or operating arm 172, 174 to operate the linkage 200 as is depicted in FIG. 2 to release the rotary latch assemblies 142, 144 from engagement with the strikers 152, 154.

While the foregoing description discloses the preferred manner in which the latch and lock system of the present invention is utilized on lengthy tool boxes of the type often mounted on pickup trucks and the like, those who are skilled in the art will recognize that features of invention also can be utilized on doors and in conjunction with other types of closures, and that the push button operator assemblies can be utilized with other types of latch and lock systems.

Figures 22, 23:
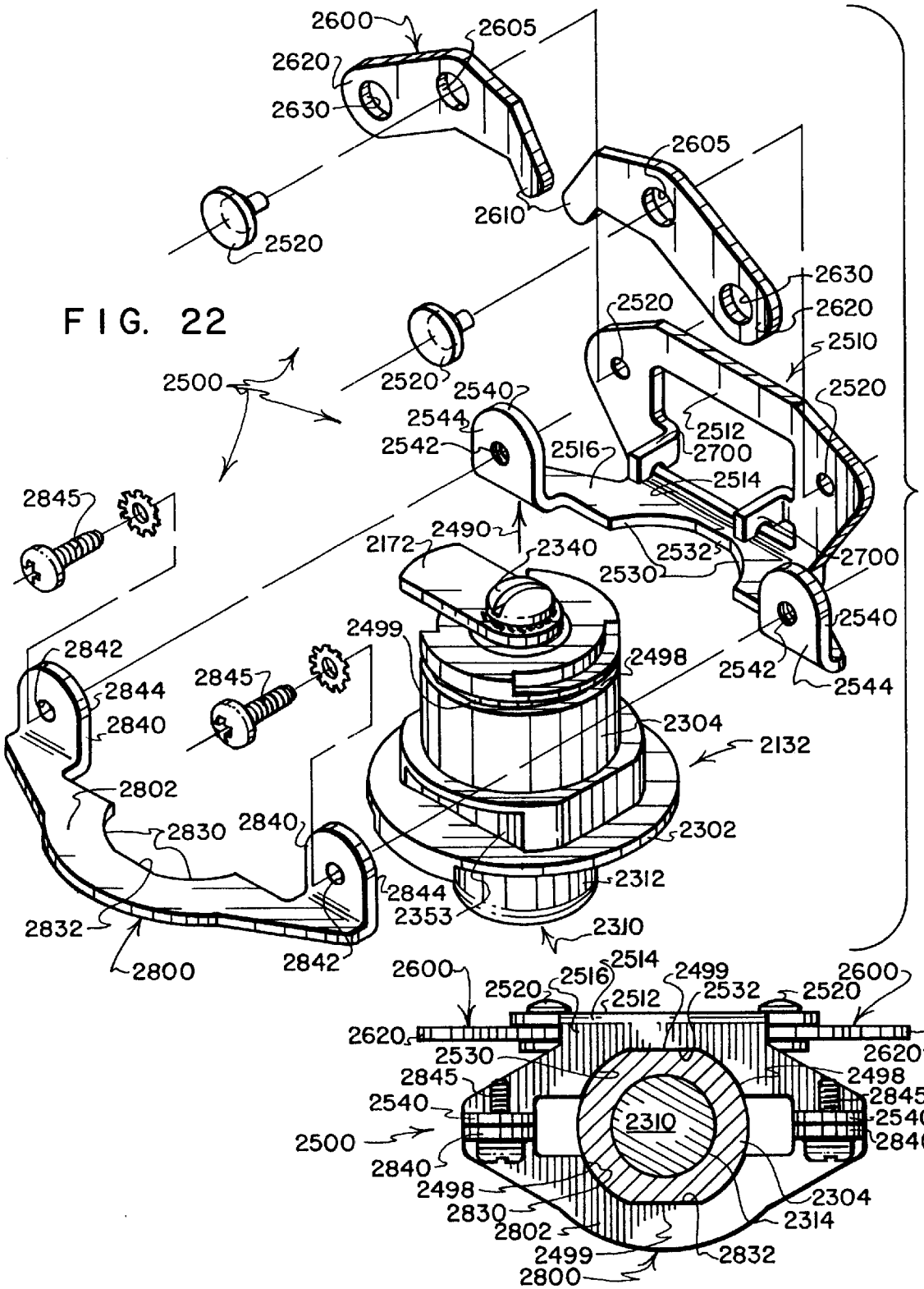

For example, a slightly modified form of the left push button operator assembly 132 is shown in FIG. 22 where it is designated by the corresponding numeral 2132. The push button operator assemblies 132, 2132 are identical with the exceptions that 1) the assembly 2132 employs a shorter operating arm 2172 (i.e., it is shorter than the corresponding operating arm 172 of the assembly 132); and, 2) the rear end region of the tubular body 2304 of the housing 2300 of the push button operator assembly 2132 is provided with a circumferentially extending groove 2498 (whereas the rear end region of the tubular body 304 of the housing 300 of the push button operator assembly 132 has no such circumferentially extending groove).

Since the push button operator assemblies 132, 2132 are identical except for the relatively small differences that are identified just above, corresponding numerals that differ by a magnitude of two thousand are utilized in FIGS. 3, 4, 7 and 9 (where features of the assembly 132 are shown) and in FIGS. 12–23 (where features of the assembly 2132 are shown) to indicate features of the push button operator assemblies 132, 2132 that either are identical or that at least "correspond" in general arrangement and function. The use of "corresponding numerals" eliminates the need to repeat portions of the foregoing description pertaining to the push button operator assembly 132 inasmuch as this same description has application to features of the push button operating assembly 2132 designated by numerals that "correspond" to the numerals used with the embodiment 132 but differ therefrom by a magnitude of two thousand.

Referring to FIGS. 22 and 23, the circumferentially extending groove 2498 is of generally uniform depth except where, on opposite sides of the body or housing 2304, the generally cylindrical bottom wall of the groove 2498 is provided with a pair of flat surfaces 2499 that slightly increase the depth of the groove 2498 where the flat surfaces 2499 are located. The flat surfaces 2499 can be thought of as "orientation formations" that can be engaged by correspondingly configured structures that extend into the groove 2498 and into engagement with the flat surfaces 2499 to orient such structures so they are properly positioned about the circumference of the body or housing 2304 to cooperate with the operating arm 2172 of the push button operator assembly 2138.

Referring to FIGS. 12–16 and 19, a clamp-on bracket and linkage assembly 2500 is one such structure that is designed with portions intended to extend into the groove 2498, and intended to be "oriented" in a proper manner about the circumference of the body or housing 2300 by engaging the flat surface 2499. The bracket and linkage assembly 2500 is shown mounted on the rear end region 2304 of the housing 2300 of the push button operator assembly 2132. While the elements of the bracket and linkage assembly 2500 are depicted in various ones of FIGS. 12–16 and 19 in various relative orientations (these relative orientations will be discussed shortly), the actual configurations of the elements of the bracket and linkage assembly 2500 are most easily seen in FIGS. 22, to which primary reference is made in the description that immediately follows.

The clamp-on bracket and linkage assembly 2500 has at its heart a right angle bracket 2510 which includes a rearwardly extending leg 2512 that is connected by a right angle bend 2514 to a transversely extending leg 2516. The rearwardly extending leg 2512 extends along one side of a path of movement, indicated by an arrow 2490, that is followed by the operating arm 2172 when the operating arm 2172 moves forwardly and rearwardly when the push button 2310 is pushed rearwardly and released to move forwardly (under the influence of the spring contained within the body or housing 2300). Along opposite sides of the path of movement 2490, 1) holes 2520 are formed through the rearwardly extending leg 2512 to receive shoulder rivets 2522 that extend through holes 2605 formed in the J-shaped arms 2600 to pivotally mount J-shaped linkage arms 2600, and 2) inwardly-turned tab-shaped stops 2700 are provided that engage inner end regions 2610 of the J-shaped linkage arms 2600 when the J-shaped linkage arms 2600 are in their non-operated positions.

The transversely extending leg 2516 has a centrally located generally concave edge surface or "first concave formation" 2530 that is configured to be received in and to seat against one side of the generally cylindrical bottom wall of the groove 2498 formed in the rear end region of the tubular body or housing 2304 of the push button operator assembly 2132. At the center of the first concave formation 2530, a flat surface 2532 is provided that is configured to engage one of the flat surfaces 2499 provided within the groove 2498 to properly orient the right angle bracket 2510 so as to properly position the J-shaped linkage arms 2600 so that inner end regions 2610 of the arms 2600 will be engaged and oppositely pivoted by the operating arm 2172 when the operating arm 2172 is moved rearwardly from the unlocked non-operated position depicted in FIGS. 14 and 15 to the unlocked operated position depicted in FIG. 16.

The transversely extending leg 2516 also has a pair of rearwardly turned clamping tabs 2540 that carry threaded holes 2542 that open through "engagement surfaces" 2544 that are defined by the tabs 2540. The engagement surfaces 2544 extend in a common plane that parallels the forwardly-rearwardly extending path of movement 2490 of the operating arm 2172—a plane that also parallels the flat surface 2532 provided at the center of the first concave formation 2530.

Figure 12:
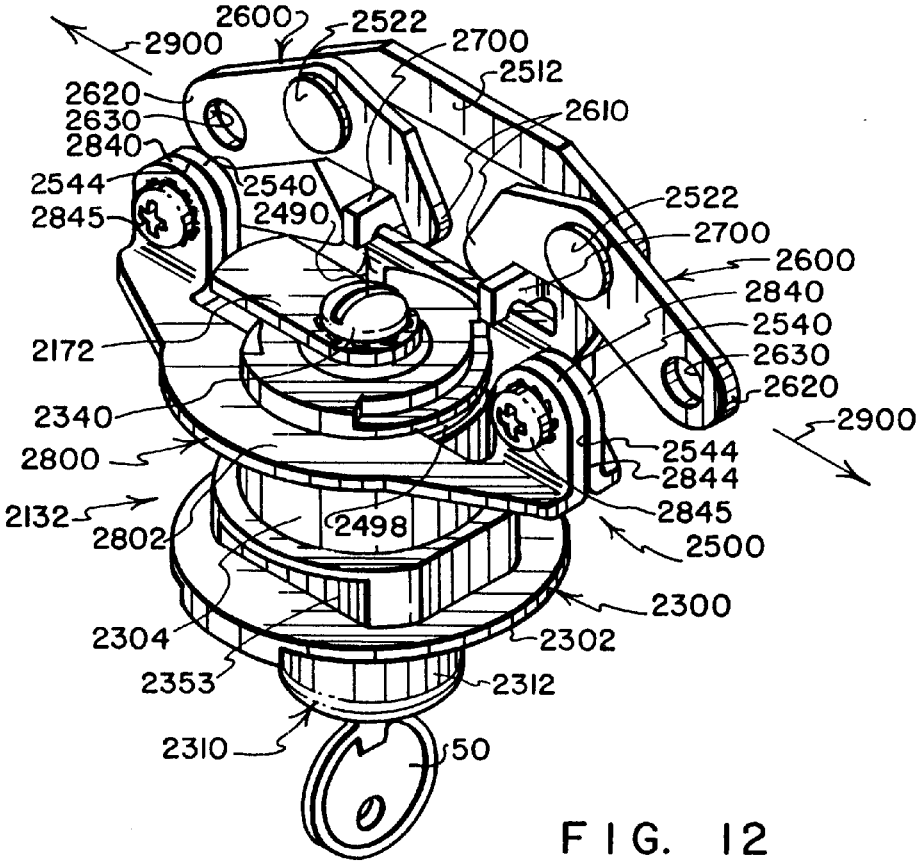
FIG. 12 is a perspective view showing a bracket and linkage assembly clamped on to a modified form of the push button operator of FIG. 3, with an operating arm of the push button operator assembly turned to a locked non-operated position by an inserted key, and with a pair of J-shaped linkage arms in their non-operated positions engaging stops.
Figure 13:
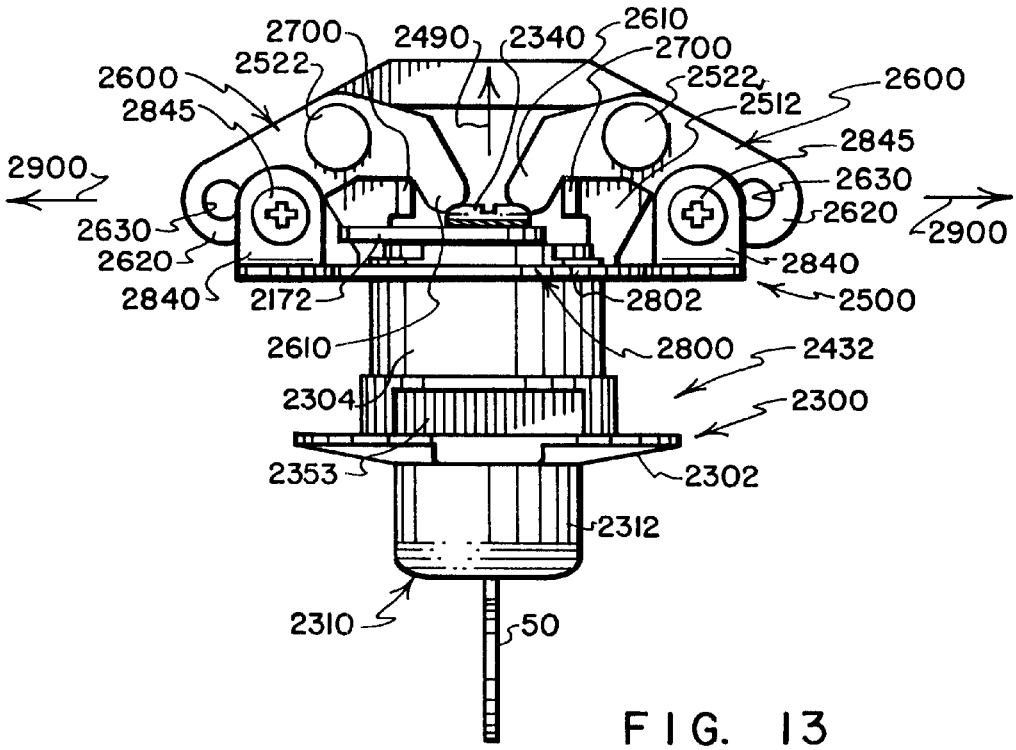
FIG. 13 is a side elevational view thereof.
Figure 14:
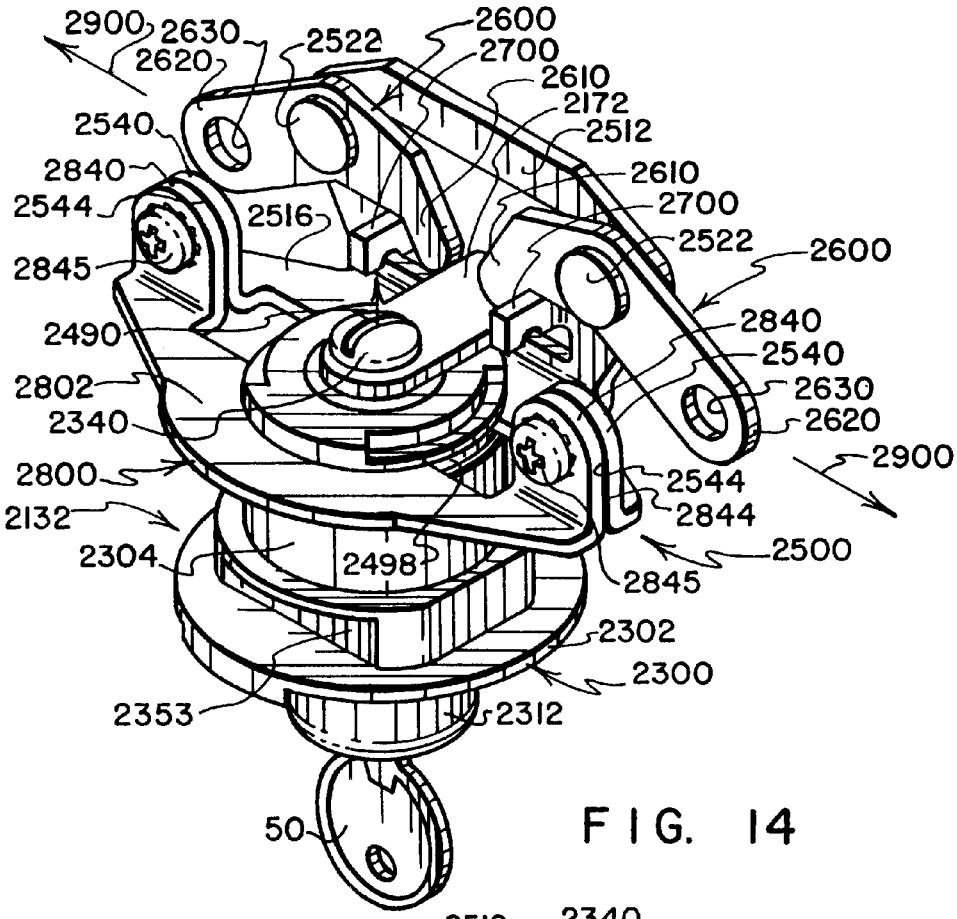
FIG. 14 is a perspective view similar to FIG. 12 but with the operating arm of the push button operator turned by the inserted key to an unlocked and non-operated position, and with the J-shaped linkage arms still in their non-operated positions engaging stops.
Figure 15:
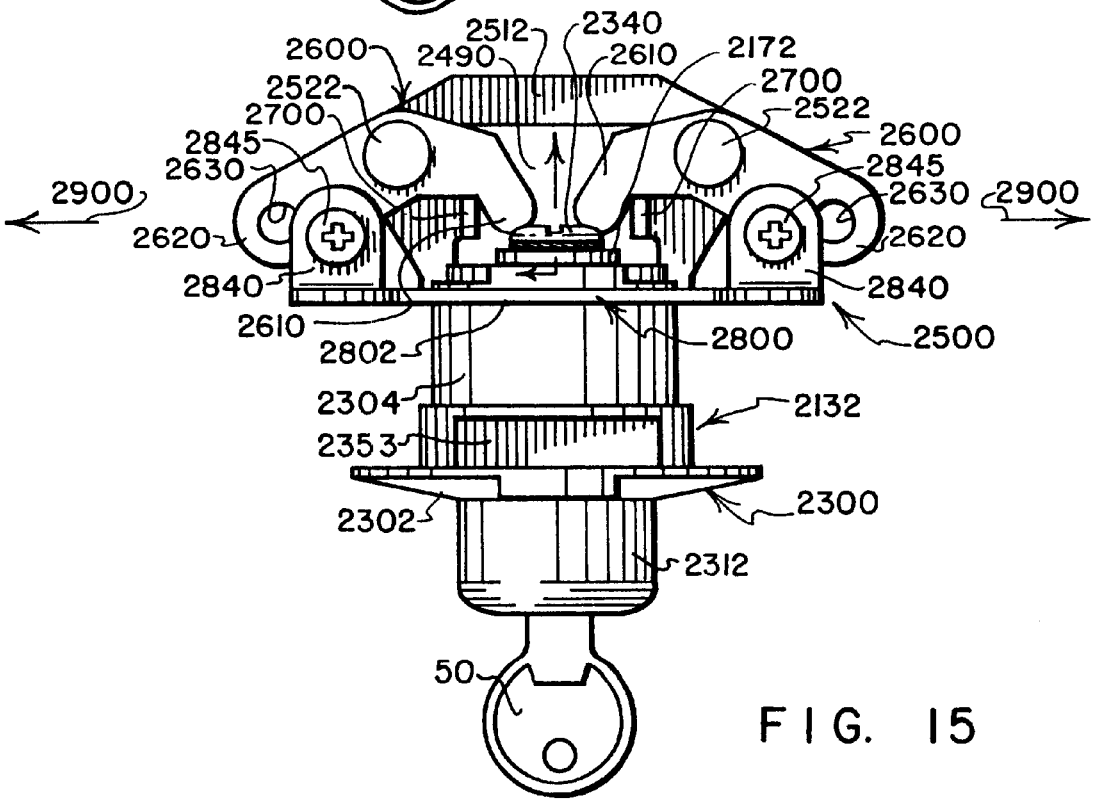
FIG. 15 is a side elevational view thereof.

The rearwardly turned clamping tabs 2540 are located on opposite sides of the first concave formation 2530 and spaced therefrom by a distance that is sufficient to ensure that the tabs 2540 do not interfere with the pivoting of the operating arm 2172 from an unlocked position depicted in FIGS. 14 and 15 to the locked position that is depicted in FIGS. 12 and 13. Since the operating arm 2172 can be installed to extend, when locked, either leftwardly (as is depicted in FIGS. 12 and 13) or rightlywardly (in a direction opposite to that shown in FIGS. 12 and 13) to enable the push button operator assembly 2132 to be installed on "left hand" and "right hand" closures without causing a keyway defined within the push button 2310 (to receive a key 50 that is shown in FIGS. 12–16) being perceived as being "upside down," the tabs 2540 are spaced equidistantly from the first concave formation 2530 by distances that prevent the tabs 2540 from obstructing the. locking and unlocking movements of the operating arm 2172 regardless of whether it is mounted on the assembly 2138 for "left" or "right" installations on a closure.

The bracket and linkage assembly 2500 also includes a clamping member 2800 that defines a second concave formation 2830 that corresponds in configuration to the first concave formation 2530; a flat surface 2832 that corresponds in configuration to the flat surface 2532; a pair of clamping tabs 2840 positioned on opposite sides of the second concave formation 2830 in the manner in which the tabs 2540 are positioned on opposite sides of the first concave formation 2530; with the clamping tabs 2840 defining engagement surfaces 2844 through which unthreaded holes 2842 are formed that are arranged to align with the threaded holes 2542 when the clamping tabs 2840 are moved into engagement with the clamping tabs 2540 so that threaded fasteners 2845 can be inserted through the holes 2842 and threaded into the holes 2542 to clamp the clamping member 2800 toward the transverse leg 2516 of the right angle bracket 2510 to seat the first and second concave formations 2530, 2830 in opposite sides of the groove 2498 with the flat surfaces 2532, 2832 engaging the flat surfaces or "orientation formations" 2499 to rigidly mount and properly orient the bracket and linkage assembly 2500 on the housing 2300 of the push button operator assembly 2132.

A feature of this means of mounting the bracket and linkage assembly 2500 on the rear end region of the tubular body 2304 of the housing 2300 is that the groove 2498 can be provided quite near the very rear of the housing 2300 so as to not interfere with other member or components of other systems (not shown) than may need to occupy space surrounding portions of the body 2304 that are located forwardly with respect to the groove 2498. Another feature of this means of mounting the bracket and linkage assembly 2500 on the rear end region of the tubular body 2304 is that central portions of the transverse leg 2516 and the central part 2802 of the clamping member extend in the same transversely extending plane that is occupied by the groove 2498 so as to define meaty formations located on opposite sides of the groove 2498 that are securely clamped into engagement with opposite side regions of the body or housing 2300, whereby a simple means is provided for connecting the bracket and linkage assembly 2500 to the push button operator assembly 2312—a connection that can be implemented with reasonable ease within a confined space by tightening the fasteners 2845 to clamp together the tabs 2540, 2840 which extend rearwardly relative to the groove 2498 so as to position the fasteners 2845 behind the housing or body 2300 to minimize the presence of structure in the region located forwardly of the groove 2498 that may need to be occupied by other components of other systems (not shown).

Referring to FIGS. 12 and 13, holes 2630 are provided in outer end regions 2620 of the J-shaped linkage arms 2600 for connection with conventional elongate links (not shown) which, in turn, connect with conventional latch assemblies, for example in the manner in which links 800 are shown to be connected to remotely located latch assemblies 1100 in FIGS. 1 and 2 of referenced U.S. Pat. No. 5,595,076 (the disclosure of which is incorporated herein by reference). Conventional latch assemblies selected to be operated by pivotal movements of the J-shaped linkage arms 2600 preferably are of the type (exemplified by the latches 1100 of U.S. Pat. No. 5,595,076) having springs that serve to tension the links that are connected to the J-shaped arms 2600 at the locations of the holes 2630—so that the J-shaped arms 2600 will be biased toward non-operated positions wherein the inner end regions 2610 of the J-shaped linkage arms 2600 engage the stops 2700 that are defined by the rearwardly extending leg 2512 of the right angle bracket 2510.

Figure 19:
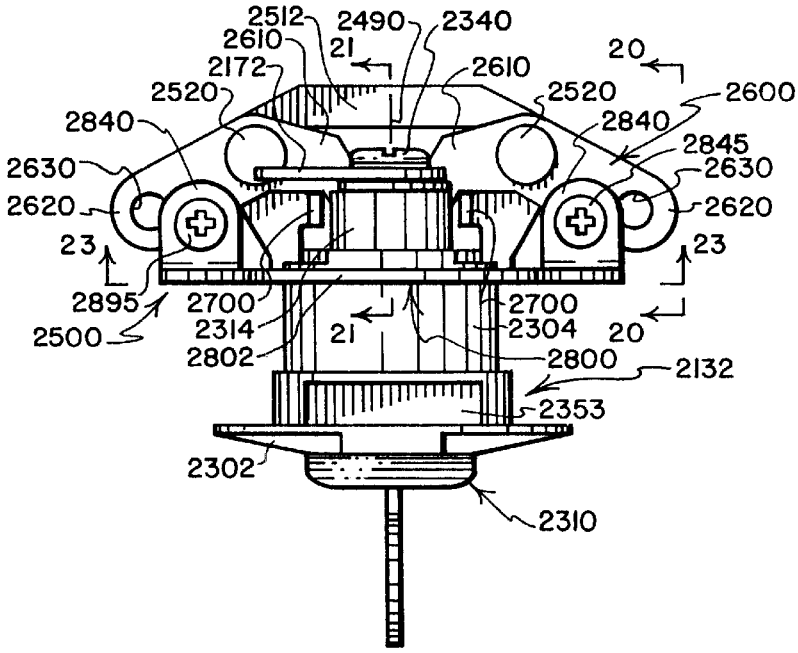
FIG. 19 is an elevational view similar to FIG. 13 showing that, when the push button is depressed so as to move the operating arm rearwardly at a time when the operating arm is in its locked position, this causes no corresponding pivotal movement of the J-shaped linkage arms away from their non-operated positions.
Figure 20:
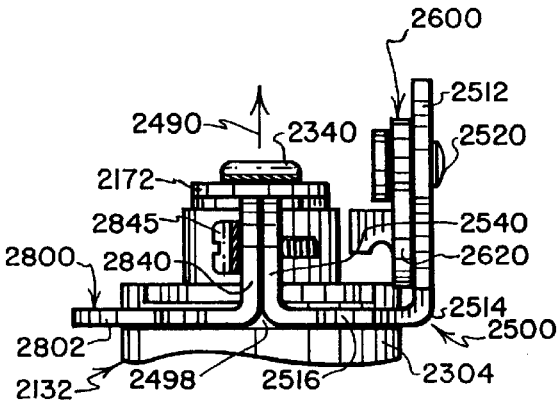
FIG. 20 is an enlarged elevational view of selected portions of the push button operator and selected portions of the bracket and linkage assembly as seen from a plane indicated by a line 20—20 in FIG. 19.
Figure 21:
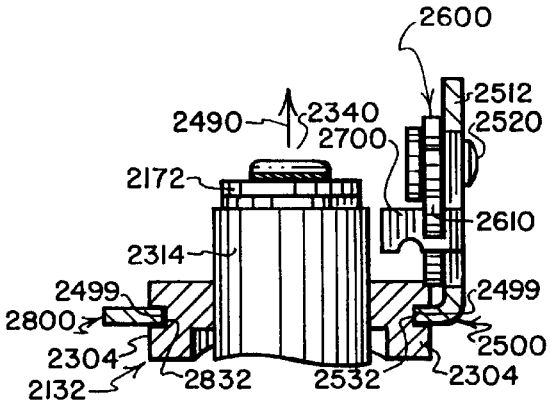
FIG. 21 is an enlarged sectional view as seen from a plane indicated by a line 21—21 in FIG. 19; and, FIG. 22 is an exploded perspective view showing components of the push button operator assembly; and, FIG. 23 is a sectional view as seen from a plane indicated by a line 23—23 in FIG. 19.

Referring to FIGS. 12 and 13, when the operating arm 2172 is rotated (by the key 50 inserted in a key operated lock cylinder carried internally by the push button 2310 in the manner described previously in conjunction with the push button operator assembly 132) to its locked position, the operating arm 2172 cannot pivot the J-shaped linkage arms 2600 out of their non-operated positions. This is illustrated in FIGS. 19–21 where the locked operating arm 2172 is shown moved rearwardly (by depressing the push button 2310)—it being seen that the operating arm 2172 is out of alignment with and therefore does not engage the J-shaped linkage arms 2600 during such movement.

Figure 16:
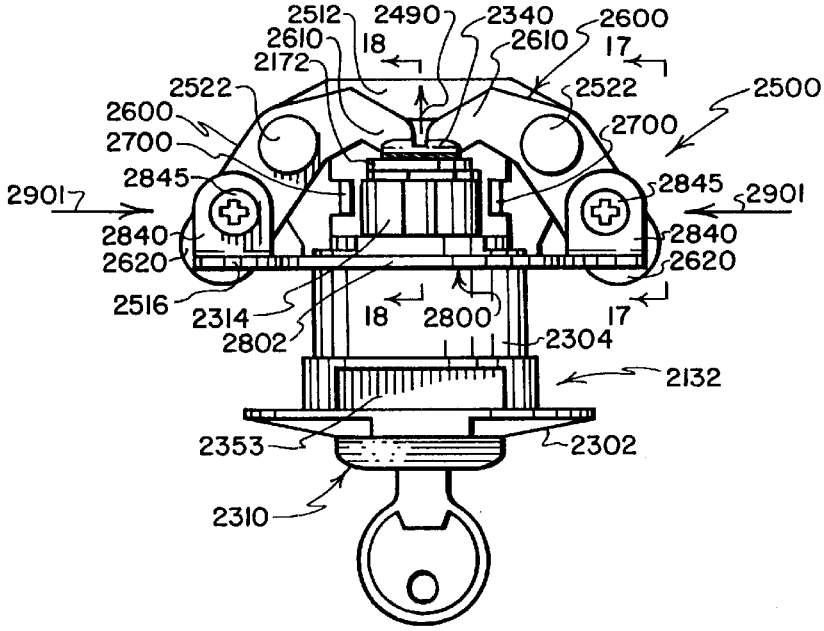
FIG. 16 is a side elevational view similar to FIG. 15 but showing the push button of the push button operator assembly depressed which causes the operating arm to move rearwardly while unlocked to an operated position which, in turn, causes the J-shaped linkage arms to be oppositely pivoted to their operated positions.
Figure 17:
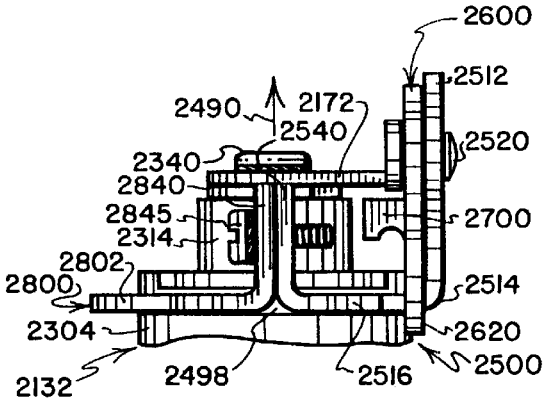
FIG. 17 is an enlarged elevational view of selected portions of the push button operator and selected portions of the bracket and linkage assembly as seen from a plane indicated by a line 17—17 in FIG. 16.
Figure 18:
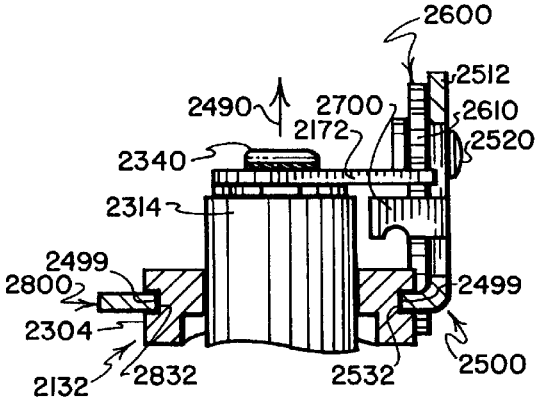
FIG. 18 is an enlarged sectional view as seen from a plane indicated by a line 18—18 in FIG. 16.

Referring to FIGS. 14 and 15, when the operating arm 2172 is unlocked but still in a non-operated position (it is unlocked by rotating the key 50 to an unlocked position), the operating arm 2172 is aligned with the inner end regions 2610 so that, when the operating arm 2172 is moved rearwardly to an operated position, as shown in FIGS. 16–18, the operating arm 2172 engages the inner end regions 2610 of the J-shaped linkage arms 2600 to pivot the arms 2600 from their non-operated positions of FIGS. 14 and 15 to their operated positions, as shown in FIGS. 16–18. By this arrangement, the rearward movement of the push button 2310 is converted to oppositely directed left and right movements (see the arrows 2901 in FIG. 16) of such links as may be connected to the outer end regions 2620 of the J-shaped operating arms 2600.

As will be apparent from the foregoing discussion taken in conjunction with the disclosure of the drawings and the claims that follow, the present invention offers a number of push-button operating assembly related features that include improvements in providing a weather resistant push button operator assembly, improvements in symmetrically balanced push-button operated latch and lock systems for pickup truck boxes and the like that utilize push button operators located at opposite ends of the boxes to release pairs of latch assemblies that hold the lids of these boxes closed, and improvements in bracket and linkage assemblies designed for rigid mounting to the bodies or housings of the push button operator assemblies.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

What is claimed is:

1. A latch system for a pickup truck box having a body, with a length of the body being defined by opposed, relatively long sides that extend between opposed, relatively shorter ends of the body, and having a lid, with a length of the lid being defined by opposed sides that extend along the length of the body between opposed ends of the lid, with the lid being connected to the body by at least one hinge located along one of the opposed sides of the lid for pivoting the lid relative to the body between open and closed positions, with the latch system being operable to releasably retain the lid in the closed position, and comprising:

a) first and second push button operators adapted to be attached to a selected one of the body and the lid at locations near the ends of the selected one of the body and the lid, with an imaginary center plane being located substantially mid-way between the locations where the first and second push button operators are attached to the selected one of the body and the lid, with each of the push button operators having a generally tubular housing that slidably mounts a push button within a central passage defined by the housing, with each push button having an operating arm associated therewith by being connected thereto for movement therewith, and wherein the push buttons and their associated operating arms are movable in directions toward and away from the center plane between non-operated positions of the operating arms and operated positions of the operating arms;

b) a reversing crank adapted to be mounted inside the box and adapted to be connected to the selected one of the body and the lid at a location near the center plane for pivoting about an axis, and having opposed end regions that extend in opposite directions away from the axis to define first and second points of connection located on opposite sides of the axis and substantially equidistantly from the axis;

c) first and second latch strikers adapted to be attached to a different one of the body and the lid at spaced locations along the length of the different one of the body and the lid, which locations are substantially equidistant from the center plane;

d) first and second latch assemblies adapted to be attached to the selected one of the body and the lid at first and second locations for latchingly engaging a corresponding one of the first and second strikers when the lid is closed, with the latch assemblies having releases that are capable of being moved concurrently from non-operated positions of the releases to operated positions of the releases for substantially concurrently unlatching the latching engagement of the latch assemblies with the strikers so that the lid can be pivoted to the open position, with the first and second locations of the latch assemblies being substantially equidistant from the center plane, and with the releases being movable in opposite directions relative to the center plane when being moved from the non-operated positions of the releases to the operated positions of the releases to unlatch the latch assemblies; and, e) linkage means for connecting the operating arms, the releases and the points of connection of the reversing crank for enabling either of the operating arms, when moved from the non-operated position thereof to the operated position thereof, to effect substantially concurrent movement of the releases from the non-operated positions of the releases to the operated positions of the releases to unlatch the latch assemblies from latchingly engaging the strikers to thereby enable the lid to be pivoted from the closed position to the open position.

2. The system of claim 1 wherein the push buttons each define an interior passage wherein a key operated lock cylinder is housed that can be operated by a key to move the associated one of the operating arms between locked and unlocked positions of the associated one of the operating arms, and wherein the operating arms are configured such that, when a chosen one of the operating arms is in the locked position of the chosen one of the operating arms, the chosen one of the operating arms is prevented from cooperating with the linkage means to unlatch the latch assemblies, whereas, when the chosen one of the operating arms is in the unlocked position of the chosen one of the operating arms, the chosen one of the operating arms cooperates with the linkage means to unlatch the latch assemblies when the chosen one of the operating arms is moved from the non-operated position of the chosen one of the operating arms to the operated position of the chosen one of the operating arms.

3. The system of claim 2 wherein at least a selected one the first and second push button operators has at least a first resilient O-ring seal positioned in the central passage of the housing thereof surrounding a portion of the push button thereof, and at least a second resilient O-ring seal positioned in the interior passage of the push button thereof surrounding a portion of the key operated lock cylinder thereof, for minimizing the transmission through the central passage and the interior passage of moisture.

4. The system of claim 2 wherein the operating arms of the push button operators are connected to the key operated lock cylinders and move between the locked and unlocked positions by rotating approximately a quarter turn relative to the housings of the push button operators as a result of the key operated lock cylinders being turned approximately a quarter turn relative to the housings of the push button operators, and means is provided to limit the turning of the key operated lock cylinders and the operating arms to approximately a quarter turn relative to the housings of the push button operators.

5. The system of claim 4 wherein the means includes formations defined by the housings that are configured to be engaged by formations of the operating arms to limit the rotation of the operating arms relative to the housings to approximately a quarter turn, and means 1) for preventing the push buttons from rotating relative to the housings and, 2) for limiting the rotation of the key operated lock cylinders with respect to the push buttons to approximately a quarter turn.

6. The system of claim 1 wherein the linkage means includes first linking means for connecting the operating arm of the first push button operator, the release of the first latch assembly, and the first point of connection of the reversing crank, and second linkage means for connecting the operating arm of the second push button operator, the release of the second latch assembly, and the second point of connection of the reversing crank.

7. The system of claim 6 wherein the first linking means includes a first link connecting the operating arm of the first push button operator and the release of the first latch assembly, and a second link connecting the release of the first latch assembly and the first point of connection, and means for adjusting the effective lengths of the first and second links at locations where the first and second links connect with the release of the first latch assembly.

8. The system of claim 7 wherein the second linking means includes a third link connecting the operating arm of the second push button operator and the release of the second latch assembly, and a fourth link connecting the release of the second latch assembly and the second point of connection, and means for adjusting the effective lengths of the third and fourth links at locations where the third and fourth links connect with the release of the second latch assembly.

9. The system of claim 8 wherein the linkage means is configured such that, when the operating arm of the first push button operator is moved from the non-operated position thereof to the operated position thereof, the connections of the first, second, third and fourth links with the reversing crank and with the releases of the first and second latch assemblies causes the third link to move away from the operating arm of the second push button operator, and, when the operating arm of the second push button operator is moved from the non-operated position thereof to the operated position thereof, the connections of the first, second, third and fourth links with the reversing crank and with the releases of the first and second latch assemblies causes the first link to move away from the operating arm of the first push button operator.

10. The system of claim 8 wherein the axis about which the reversing crank pivots is located substantially equidistantly between and quite near to an imaginary line drawn between where the second and fourth links connect with the first and second releases of the first and second latch assemblies, respectively.

11. The system of claim 8 wherein the first and third links extend substantially horizontally, substantially in alignment one with another.

12. A latch system for a pickup truck box having an elongate body and a lid hinged to open along a length of the body, comprising:

a) first and second latch strikers adapted to be attached to the lid;

b) first and second latch assemblies for mounting inside the body for engagement with a corresponding striker when the lid is closed, with the latch assemblies having releases that are movable to unlatch the latches;

c) first and second push button latch operators having housings adapted to be mounted in openings formed through body near opposite ends of the body, with the latch operators including operating arms that are moved between non-operated and operated positions when push buttons of the latch operators are pushed; and, d) means for interconnecting the operating arms of the latch operators and the releases of the latch assemblies for enabling either of the latch operators to concurrently unlatch the latch assemblies when one of the push buttons is pushed, including a reversing crank mounted inside the body for pivotal movement about an axis located near an imaginary center plane located substantially midway between the first and second latch releases and substantially midway between the first and second latch operators, first means for extending to one side of the center plane for connecting the release of the first latch assembly with the first operating arm and with the reversing crank, and second means for extending to the other side of the center plane for connecting the release of the second latch assembly with the second operating arm and with the reversing crank such that the reversing crank causes the first means and the second means to move in opposite directions relative to the center plane when the releases of the latch assemblies are being moved by one of the latch operators to unlatch the latch assemblies.

13. The latch system of claim 12 additionally including key operated lock cylinders carried by the push buttons and connected to the operating arms for moving the operating arms to locked positions wherein the operating arms are incapable of cooperating with the means for interconnecting the operating arms of the latch operators and the releases of the latch assemblies to unlatch the latch assemblies.

14. A latch and lock system for a pickup truck box having a body, with a length of the body being defined by opposed, relatively long sides that extend between opposed, relatively shorter ends of the body, and having a lid, with a length of the lid being defined by opposed sides that extend along the length of the body between opposed ends of the lid, with the lid- being connected to the body by at least one hinge located along one of the opposed sides of the lid for pivoting the lid relative to the body between open and closed positions, with the latch system being operable to releasably retain the lid in the closed position, and comprising:

a) first and second push button operators adapted to be attached to a selected one of the body and the lid at locations near the ends of the selected one of the body and the lid, with an imaginary center plane being located substantially mid-way between the locations where the first and second push button operators are attached to the selected one of the body and the lid, with each of the push button operators including:

i) a generally tubular housing having a central passage extending therethrough along an imaginary central axis of the housing and opening through forward and rearward ends of the housing;

ii) a push button slidable within the central passage between non-operated and operated positions, with the push button having a forward end region, a rearward end region, and an interior passage extending therethrough along the central axis of the housing and opening through the forward and rearward end regions;

iii) a key operated lock cylinder carried within the interior passage and being rotatable relative to the housing about the central axis of the housing between locked and unlocked positions of the key operated lock cylinder, with the key operated lock cylinder having a front end region that is configured to receive a key configured to rotate the key operated lock cylinder between the locked and unlocked positions of the key operated lock cylinder, and a rear end region that projects from the rearward end of the housing;

iv) means for limiting the rotation of the key operated lock cylinder relative to the housing when moving between the locked and unlocked positions of the key operated lock cylinder to approximately a quarter turn;

v) an operating arm connected to the rear end region of the key operated lock cylinder and being configured to extend transversely with respect to the central axis of the housing for pivotal movement between locked and unlocked positions of the operating arm when the key operated lock cylinder is rotated relative to the housing between the locked and unlocked positions of the key operated lock cylinder;

vi) with the push button and the operating arm connected to the key operated lock cylinder being movable in unison toward and away from the center plane to move the operating arm between non-operated and operated positions of the operating arm when the operating arm is in the unlocked position of the operating arm; and vii) sealing means for preventing the passage of moisture through the central passage of the housing and through the interior passage of the push button including at least a first resilient O-ring seal in the central passage surrounding a portion of the push button, and at least a second resilient O-ring means in the interior passage surrounding a portion of the key cylinder;

b) a reversing crank adapted to be mounted inside the box and adapted to be connected to the selected one of the body and the lid at a location near the center plane for pivoting about an axis, and having opposed end regions that extend in opposite directions away from the axis to define first and second points of connection located on opposite sides of the axis and substantially equidistantly from the axis;

c) first and second latch strikers adapted to be attached to a different one of the body and the lid at spaced locations along the length of the different one of the body and the lid, which locations are substantially equidistant from the center plane;

d) first and second latch assemblies adapted to be attached to the selected one of the body and the lid at first and second locations for latchingly engaging a corresponding one of the first and second strikers when the lid is closed, with the latch assemblies having releases that are capable of being moved concurrently from non-operated positions of the releases to operated positions of the releases for substantially concurrently unlatching the latching engagement of the latch assemblies with the strikers so that the lid can be pivoted to the open position, with the first and second locations of the latch assemblies being substantially equidistant from the center plane, and with the releases being movable in opposite directions relative to the center plane when being moved from the non-operated positions of the releases to the operated positions of the releases to unlatch the latch assemblies; and, e) linkage means for connecting the operating arms, the releases and the points of connection of the reversing crank for enabling either of the operating arms, when moved from the non-operated position thereof to the operated position thereof, to effect substantially concurrent movement of the releases from the non-operated positions of the releases to the operated positions of the releases to unlatch the latch assemblies from latchingly engaging the strikers to thereby enable the lid to be pivoted from the closed position to the open position.

15. The system of claim 14 wherein the linkage means includes first linking means for connecting the operating arm of the first push button operator, the release of the first latch assembly, and the first point of connection of the reversing crank, and second linkage means for connecting the operating arm of the second push button operator, the release of the second latch assembly, and the second point of connection of the reversing crank.

16. The system of claim 15 wherein the first linking means includes a first link connecting the operating arm of the first push button operator and the release of the first latch assembly, and a second link connecting the release of the first latch assembly and the first point of connection, and means for adjusting the effective lengths of the first and second links at locations where the first and second links connect with the release of the first latch assembly.

17. The system of claim 16 wherein the second linking means includes a third link connecting the operating arm of the second push button operator and the release of the second latch assembly, and a fourth link connecting the release of the second latch assembly and the second point of connection, and means for adjusting the effective lengths of the third and fourth links at locations where the third and fourth links connect with the release of the second latch assembly.

18. The system of claim 17 wherein the linkage means is configured such that, when the operating arm of the first push button operator is moved from the non-operated position thereof to the operated position thereof, the connections of the first, second, third and fourth links with the reversing crank and with the releases of the first and second latch assemblies causes the third link to move away from the operating arm of the second push button operator, and, when the operating arm of the second push button operator is moved from the non-operated position thereof to the operated position thereof, the connections of the first, second, third and fourth links with the reversing crank and with the releases of the first and second latch assemblies causes the first link to move away from the operating arm of the first push button operator.

19. The system of claim 17 wherein the axis about which the reversing crank pivots is located substantially equidistantly between and quite near to an imaginary line drawn between where the second and fourth links connect with the first and second releases of the first and second latch assemblies, respectively.

20. The system of claim 17 wherein the first and third links extend substantially horizontally, substantially in alignment one with another.

21. A push button lock operator, comprising:

a) a generally tubular housing having a central passage extending therethrough along an imaginary central axis of the housing and opening through forward and rearward ends of the housing;

b) a push button slidable within the central passage between non-operated and operated positions, with the push button having a forward end region, a rearward end region, and an interior passage extending therethrough along the central axis of the housing and opening through the forward and rearward end regions;

c) a key operated lock cylinder carried within the interior passage and being rotatable relative to the housing about the central axis of the housing between locked and unlocked positions, with the key operated lock cylinder having a front end region that is configured to receive a key configured to rotate the key operated lock cylinder between the locked and unlocked positions, and a rear end region that projects from the rearward end of the housing;

d) means for limiting the rotation of the key operated lock cylinder relative to the housing when moving between the locked and unlocked positions to approximately a quarter turn;

e) means for permitting and preventing the unlatching of at least one latch by movement of the push button from the non-operated position to the operated position including an operating arm connected to the rear end region of the key operated lock cylinder and being configured to extend transversely with respect to the central axis of the housing for alignment with linkage connected to the at least one latch when the key operated lock cylinder is in the unlocked position, and for non-alignment with the linkage when the key operated lock cylinder is in the locked position, whereby the operating arm is operable when the push button is moved from the non-operated position to the operated position while the key operated lock cylinder is in the unlocked position to engage and operate the linkage to unlatch the at least one latch, and is unable to engage and operate the linkage to unlatch the at least one latch when the push button is moved from the non-operated position to the operated position while the key operated lock cylinder is in the locked position; and, f) sealing means for preventing the passage of moisture through the central passage of the housing and through the interior passage of the push button including at least a first resilient O-ring seal in the central passage surrounding a portion of the push button, and at least a second resilient O-ring means in the interior passage surrounding a portion of the key cylinder.

22. The push button lock operator of claim 21 wherein the means for limiting the rotation of the key operated lock cylinder relative to the housing when moving between the locked and unlocked positions to approximately a quarter turn includes at least one formation defined by the housing that is configured to be engaged by at least one formation defined by the operating arm to limit the rotation of the operating arm relative to the housing to approximately a quarter turn, and means for preventing the push button from rotating relative to the housing and for limiting the rotation of the key operated lock cylinder with respect to the push button to approximately a quarter turn.

23. A first and a second of the push button lock operators of claim 21 in combination with said linkage, wherein said at least one latch includes a first latch and a second latch, and wherein said linkage connects with the first and second latches and is configured to permit either of the first and second push button lock operators to unlatch the first and second latches substantially concurrently.

24. The push button lock operator of claim 21 in combination with said linkage, wherein said at least one latch includes a first latch and a second latch, and wherein said linkage is configured to permit the push button lock operator to unlatch the first and second latches substantially concurrently.

25. The combination of claim 24 wherein the first and second latches are mounted at spaced locations along the length of a pickup truck box, wherein the first and second latches have release arms that are movable in opposite unlatching directions to effect unlatching of the first and second latches, wherein said linkage includes a reversing crank located substantially midway between the release arms and links that connect the release arms with the reversing crank so that the latch arms are caused to move substantially concurrently in opposite unlatching directions when the linkage causes either of the latch arms to move in an unlatching direction.

26. The combination of claim 24 wherein said linkage includes a bracket and linkage assembly, having:

a) a right angle bracket having a rearward extending leg connected by a right angle bend to a transversely extending leg;

b) means for connecting the right angle bracket to the housing so that the transversely extending leg extends in a plane that intersects a rear end region of the housing and positions the rearwardly extending leg to substantially parallel the central axis at a distance spaced therefrom and alongside a path of movement that is followed by the operating arm when moving between the non-operated and operated positions of the operating arm;

c) a pair of J-shaped linkage arms connected to the rearwardly extending leg and having inner end regions positioned along the path of movement and configured to define said linkage that is aligned with and engageable by the operating arm when the key operated lock cylinder is in the unlocked position, such that, when the operating arm moves between the non-operated and operated positions of the operating arm while the key operated lock cylinder is in the unlocked position, the J-shaped linkage arms are caused to pivot in opposite directions of rotation from non-operated to operated positions of the J-shaped linkage arms for operating other elements of said linkage that are connected to the first and second latches.

27. The combination of claim 26 wherein the means for connecting the right angle bracket to the housing includes:

a) a circumferentially extending groove defined by the rear end region of the housing;

b) a first concave edge defined by the transversely extending leg and configured to extend into one side of the circumferentially extending groove;

c) a second concave edge defined by a clamping member and configured to extend into the other side of the circumferentially extending groove; and, d) means for clamping the first and second concave edges toward each other when the first and second concave edges extend into the one and other sides of the circumferentially extending groove so that the first and second concave edges securely grip the housing while positioning the transversely extending leg to extend within said plane.

28. A push button operator assembly for a latch including a generally cylindrical housing having a push button movable forwardly and rearwardly within a passage defined by the housing along an axis of the passage, having an operating arm connected to a rear end region of the push button for movement forwardly and rearwardly along a path of movement that parallels the axis of the passage, and having a bracket and linkage assembly including a right angle bracket with a rearwardly extending leg and a transversely extending leg that are connected by a right angle bend, a pair of J-shaped linkage arms connected to the rearwardly extending leg, and means for connecting the transversely extending leg to a rear end region of the housing and for positioning the rearwardly extending leg to extend alongside the path of movement and to position inner end regions of the J-shaped linkage arms along opposite sides of the path of movement for being engaged and pivoted in opposite directions of rotation by the operating arm when the operating arm is moved from a non-operated position of the operating arm to an operated position of the operating arm for unlatching a pair of latches that are connected to the J-shaped linkage arms, wherein the means for connecting the transversely extending leg to the rear end region of the housing includes a circumferentially extending groove formed on the rear end region of the housing, at least one concave formation defined by the transversely extending leg and configured to be received and seated in selected portions of the groove, and means for clamping the at least one concave formation into seated engagement with the selected portions of the groove.

29. The push button operator assembly of claim 28 additionally including means for orienting the right angle bracket relative to the housing including a formation defined by the transversely extending leg and configured to extend into engagement with a formation defined within the groove.

30. The push button operator assembly of claim 29 wherein the formation defined by the transversely extending leg is a flat surface, and the formation defined within the groove is a flat surface located at the bottom of the groove.

31. The push button operator assembly of claim 28 wherein the means for clamping includes a clamping member that defines at least one other concave formation configured to be received and seated in other portions of the groove, and fastening means for clamping the clamping member toward the transversely extending leg to concurrently clamp the at least one concave formation and the at least one other concave formation into seated engagement with the selected and other portions of the groove, respectively.

32. The push button operator assembly of claim 31 wherein the transversely extending leg and the clamping member define tab formations configured to extend rearwardly along opposite sides of the axis, with the tab formations of the transversely extending leg defining engagement surfaces that are clamped into engagement with engagement surfaces defined by the tab formations of the clamping member when the fastening means clamps the clamping member toward the transversely extending leg to concurrently clamp the at least one concave formation and the at least one other concave formation into seated engagement with the selected and other portions of the groove, respectively.

33. The push button operator assembly of claim 32 wherein the fastening means includes threaded fasteners that extend into holes formed in the tab formations of the clamping member and into aligned holes formed in the tab formations of the transversely extending leg.

34. The push button operator assembly of claim 31 additionally including means for orienting the right angle bracket relative to the housing including a formation defined by the clamping member and configured to extend into engagement with a formation defined within the groove.

35. The push button operator assembly of claim 34 wherein the formation defined by the clamping member is a flat surface, and the formation defined within the groove is a flat surface located at the bottom of the groove.

36. A bracket and linkage assembly attachable rigidly to a generally cylindrical body of a push button operator assembly having a housing that defines a central axis along which a push button is movable forwardly and rearwardly to move an operating arm connected to the push button between non-operated and operated positions of the operating arm, comprising:

a) a right angle bracket having a rearward extending leg connected by a right angle bend to a transversely extending leg;

b) means for connecting the right angle bracket to the housing so that the transversely extending leg extends in a plane that intersects a rear end region of the housing and positions the rearwardly extending leg to substantially parallel the central axis at a distance spaced therefrom and alongside a path of movement that is followed by the operating arm when moving between the non-operated and operated positions of the operating arm;

c) a pair of J-shaped linkage arms connected to the rearwardly extending leg and having inner end regions positioned along the path of movement for being engaged and moved by the operating arm between non-operated and operated positions of the J-shaped linkage arms when the operating arm is moved between the non-operated and operated positions of the operating arm, and wherein the J-shaped linkage arms have outer end regions adapted for connection to remotely located latches for concurrently operating the latches when the J-shaped linkage arms are moved from the non-operated positions to the operated positions of the J-shaped linkage arms; and, d) wherein the means for connecting the right angle bracket to the housing includes:

i) a circumferentially extending groove defined by the rear end region of the housing;

ii) a first concave edge defined by the transversely extending leg and configured to extend into one side of the circumferentially extending groove;

iii) a second concave edge defined by a clamping member and configured to extend into the other side of the circumferentially extending groove; and, iv) means for clamping the first and second concave edges toward each other when the first and second concave edges extend into the one and other sides of the circumferentially extending groove so that the first and second concave edges securely grip the housing while positioning the transversely extending leg to extend within said plane.

37. The bracket and linkage assembly of claim 36 additionally including means for orienting the right angle bracket relative to the housing including a formation defined by the transversely extending leg and configured to extend into engagement with a formation defined within the groove.

38. The bracket and linkage assembly of claim 37 wherein the formation defined by the transversely extending leg is a flat surface, and the formation defined within the groove is a flat surface located at the bottom of the groove.

39. The bracket and linkage assembly of claim 36 wherein the means for clamping includes a clamping member that defines at least one other concave formation configured to be received and seated in other portions of the groove, and fastening means for clamping the clamping member toward the transversely extending leg to concurrently clamp the at least one concave formation and the at least one other concave formation into seated engagement with the selected and other portions of the groove, respectively.

40. The bracket and linkage assembly of claim 39 wherein the transversely extending leg and the clamping member define tab formations configured to extend rearwardly along opposite sides of the axis, with the tab formations of the transversely extending leg defining engagement surfaces that are clamped into engagement with engagement surfaces defined by the tab formations of the clamping member when the fastening means clamps the clamping member toward the transversely extending leg to concurrently clamp the at least one concave formation and the at least one other concave formation into seated engagement with the selected and other portions of the groove, respectively.

41. The bracket and linkage assembly of claim 40 wherein the fastening means includes threaded fasteners that extend into holes formed in the tab formations of the clamping member and into aligned holes formed in the tab formations of the transversely extending leg.

42. The bracket and linkage assembly of claim 40 additionally including means for orienting the right angle bracket relative to the housing including a formation defined by the clamping member and configured to extend into engagement with a formation defined within the groove.

43. The bracket and linkage assembly of claim 42 wherein the formation defined by the clamping member is a flat surface, and the formation defined within the groove is a flat surface located at the bottom of the groove.

44. The bracket and linkage assembly of claim 40 additionally including means for orienting the right angle bracket relative to the housing including a first formation defined by the transversely extending leg and a second formation defined by the clamping member, wherein the first and second formations are configured to extend into engagement with formations defined on opposite sides of the housing and within the groove.

45. The bracket and linkage assembly of claim 44 wherein the first and second formations are flat surfaces, and the formations defined within the groove are flat surfaces located at the bottom of the groove.

46. In combination, a push button operator having a housing with a generally cylindrical rear end region, and defining a passage that extends forwardly and rearwardly through the housing that slidably mounts a push button for movement therein between non-operated and operated positions of the push button; an operating arm connected to a rear end region of the push button and being movable along a path of movement located to the rear of the housing between non-operated and operated positions of the operating arm in response to corresponding movements of the push button between the non-operated and operated positions of the push button; a bracket and linkage assembly including a bracket that pivotally mounts a link for movement between non-operated and operated positions of the link; and means for mounting the bracket and linkage assembly on the rear end region of the housing for positioning the link to be extend into the path of movement of the operating arm so as 1) to be engaged by the operating arm when the operating arm moves from the non-operated position to the operated position of the operating arm, and 2) to be pivoted as the result of such engagement from the non-operated position to the operated position of the link, wherein the means for mounting the bracket and linkage assembly on the rear end region of the housing includes a circumferentially extending groove defined by the generally cylindrical rear end region of the housing, with the groove extending in a plane that is transverse to a central axis of the passage, with the bracket defining at least one concave formation configured to be received in and to seat within one side of the groove, and means for clamping the bracket toward one side of the rear end region of the housing to firmly seat the at least one concave formation within the one side of the groove to establish a rigid connection between the housing and the bracket.

47. The combination of claim 46 wherein the means for clamping includes a clamping member that defines at least one other concave formation configured to be received in and to seat within an opposite side of the groove, and fastening means for clamping the clamping member toward the bracket to firmly seat the at least one other concave formation in the opposite side of the groove to assist in establishing a rigid connection between the housing and the bracket.

48. The combination of claim 47 wherein the bracket and the clamping member define engagement formations configured to engage at locations on opposite sides of the rear end region of the housing when the one and the other concave formations are firmly seated in the groove, and the fastening means includes fasteners that maintain the engagement of the engagement formations.

49. The combination of claim 48 additionally including means for pivoting the operating arm relative to the push button between locked and unlocked positions, wherein the operating arm is inoperative when in the locked position to move along said path of movement to engage and pivot the link.

50. The combination of claim 49 wherein the means for pivoting the operating arm includes a key operated lock cylinder carried within a channel that extends through the push button along the central axis of the passage that extends through the housing, wherein a first O-ring seal is provided in the passage surrounding a portion of the push button to minimize moisture penetration through the passage, and wherein a second O-ring seal is provided in the channel surrounding a portion of the key operated lock cylinder to minimize moisture penetration through the channel.

* * * * *